US010364814B2

(12) United States Patent
Shi et al.

(10) Patent No.: US 10,364,814 B2
(45) Date of Patent: Jul. 30, 2019

(54) VACUUM PUMP

(71) Applicant: Edwards Japan Limited, Yachiyo-shi, Chiba (JP)

(72) Inventors: Yongwei Shi, Yachiyo (JP); Manabu Nonaka, Yachiyo (JP); Yoshinobu Ohtachi, Yachiyo (JP); Yasushi Maejima, Yachiyo (JP); Tsutomu Takaada, Yachiyo (JP)

(73) Assignee: Edwards Japan Limited, Chiba (JP)

( * ) Notice: Subject to any disclaimer, the term of this patent is extended or adjusted under 35 U.S.C. 154(b) by 951 days.

(21) Appl. No.: 14/763,345

(22) PCT Filed: Dec. 25, 2013

(86) PCT No.: PCT/JP2013/084634

§ 371 (c)(1),
(2) Date: Jul. 24, 2015

(87) PCT Pub. No.: WO2014/119191

PCT Pub. Date: Aug. 7, 2014

(65) Prior Publication Data

US 2016/0025096 A1 Jan. 28, 2016

(30) Foreign Application Priority Data

Jan. 31, 2013 (JP) ..... 2013-017234
Feb. 13, 2013 (JP) ..... 2013-025936

(51) Int. Cl.
*F04D 29/58* (2006.01)
*F04D 19/00* (2006.01)
(Continued)

(52) U.S. Cl.
CPC ..... *F04D 19/002* (2013.01); *F04D 19/044* (2013.01); *F04D 25/06* (2013.01);
(Continued)

(58) Field of Classification Search
CPC ..... F04D 19/042; F04D 29/40; F04D 29/522; F04D 29/584; F04D 25/06
See application file for complete search history.

(56) References Cited

U.S. PATENT DOCUMENTS 6,504,379 B1 * 1/2003 Jackson ..... H01B 7/0861 174/117 F
6,629,824 B2 * 10/2003 Yamauchi ..... F04D 19/04 417/313

(Continued)

FOREIGN PATENT DOCUMENTS

JP S5129753 A 3/1976
JP H07145952 A 6/1995

(Continued)

OTHER PUBLICATIONS

PCT International Search Report dated Apr. 8, 2014 for corresponding PCT Application No. PCT/JP2013/084634.

(Continued)

*Primary Examiner* — Carlos A Rivera
*Assistant Examiner* — Danielle M. Christensen
(74) *Attorney, Agent, or Firm* — Theodore M. Magee; Westman, Champlin & Koehler, P.A.

(57) ABSTRACT

An object is to reduce an adhesion amount of a product in a vacuum pump as a whole and effectively prevent occurrence of a trouble in a vacuum pump electric system due to a magnetic flux leak. A vacuum pump includes a rotor enclosed in a pump case, a rotating shaft fixed to the rotor, a supporting means that rotatably supports the rotating shaft, a driving means that rotates the rotating shaft, and thread-groove-exhaust-portion stators that form thread grove exhaust passages between the thread-groove-exhaust-portion stator and an outer circumferential side of or an inner circumferential side of the rotor. A heating portion is provided below the thread-groove-exhaust-portion stators. The (Continued)

heating portion includes a yoke, a coil, and a heating plate. The heating portion heats the yoke and the heating plate with electromagnetic induction heating by feeding an alternating current to the coil.

10 Claims, 19 Drawing Sheets

(51) Int. Cl.

| | |
|---|---|
| ***F04D 27/02*** | (2006.01) |
| ***F04D 29/52*** | (2006.01) |
| ***F04D 25/06*** | (2006.01) |
| ***F04D 29/053*** | (2006.01) |
| ***F04D 29/32*** | (2006.01) |
| ***F04D 29/40*** | (2006.01) |
| ***F04D 19/04*** | (2006.01) |

(52) U.S. Cl.
CPC ..... *F04D 27/0292* (2013.01); *F04D 29/053* (2013.01); *F04D 29/325* (2013.01); *F04D 29/40* (2013.01); *F04D 29/522* (2013.01); *F04D 29/584* (2013.01); *F05D 2260/607* (2013.01)

(56) References Cited

U.S. PATENT DOCUMENTS

| | | | | |
|---|---|---|---|---|
| 6,793,466 | B2 * | 9/2004 | Miyamoto | F04D 19/04 415/177 |
| 2003/0180162 | A1 | 9/2003 | Beyer et al. | |
| 2007/0052389 | A1 * | 3/2007 | Kooij | H01M 2/1066 320/114 |

FOREIGN PATENT DOCUMENTS

| | | | |
|---|---|---|---|
| JP | 2002021775 | A | 1/2002 |
| JP | 2002048088 | A | 2/2002 |
| JP | 2002180988 | A | 6/2002 |
| JP | 2004241215 | A * | 8/2004 |
| JP | 2012179409 | A | 9/2012 |

OTHER PUBLICATIONS

The specification and drawings annexed to the request of Japanese Utility Model Application No. 58093/1991 (Laid-open No. 12691/1993) (Shimadzu Corp.), Feb. 19, 1993, entire text; all drawings (family: none).

* cited by examiner

[FIG.1]
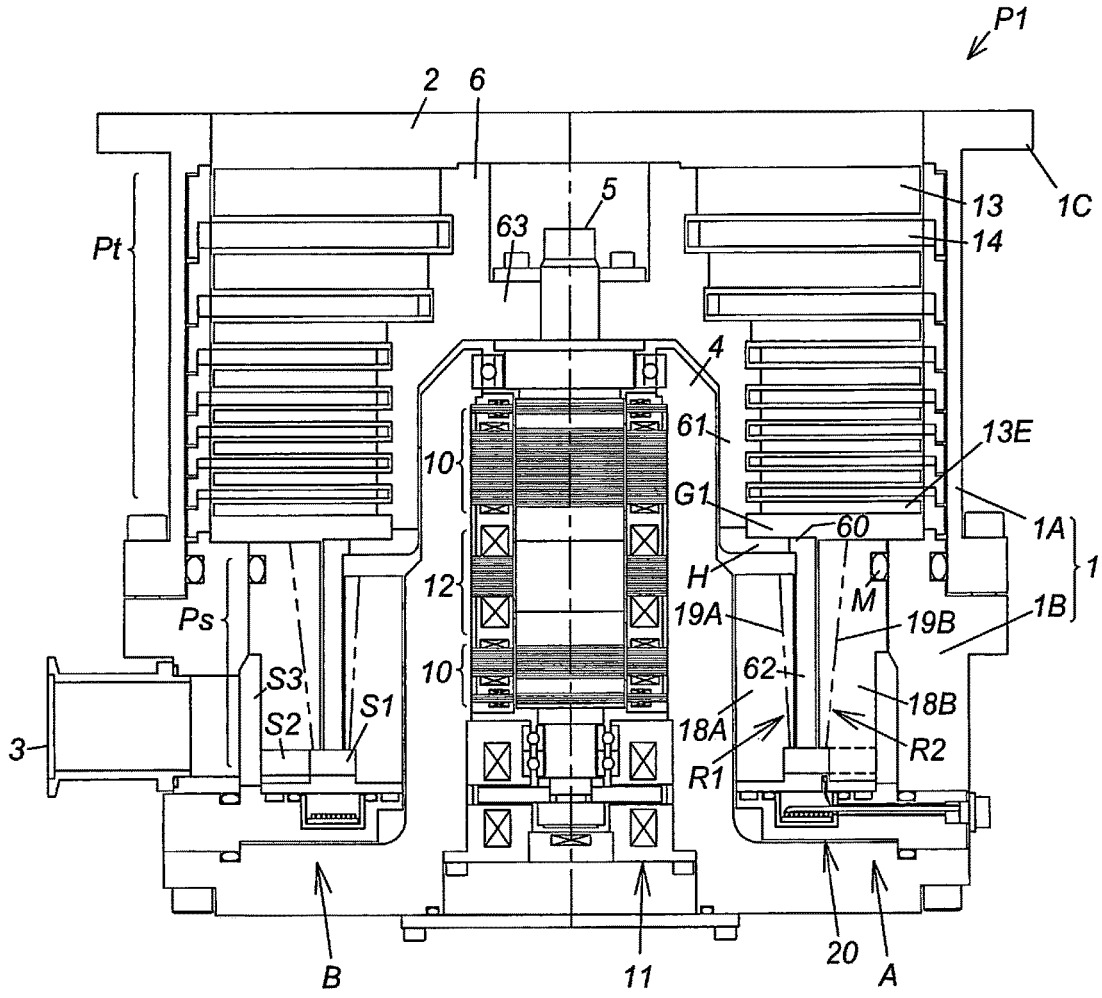

[FIG.2]
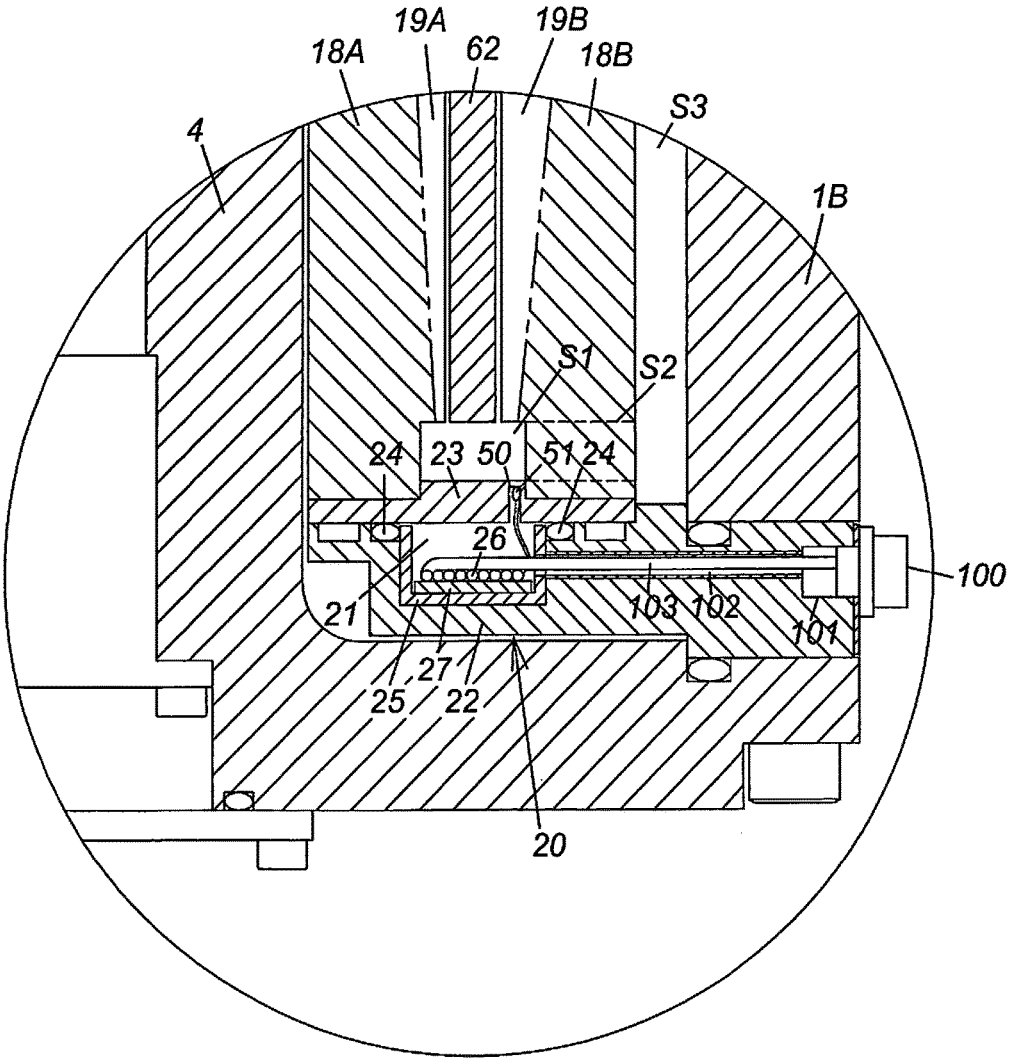

[FIG.3]
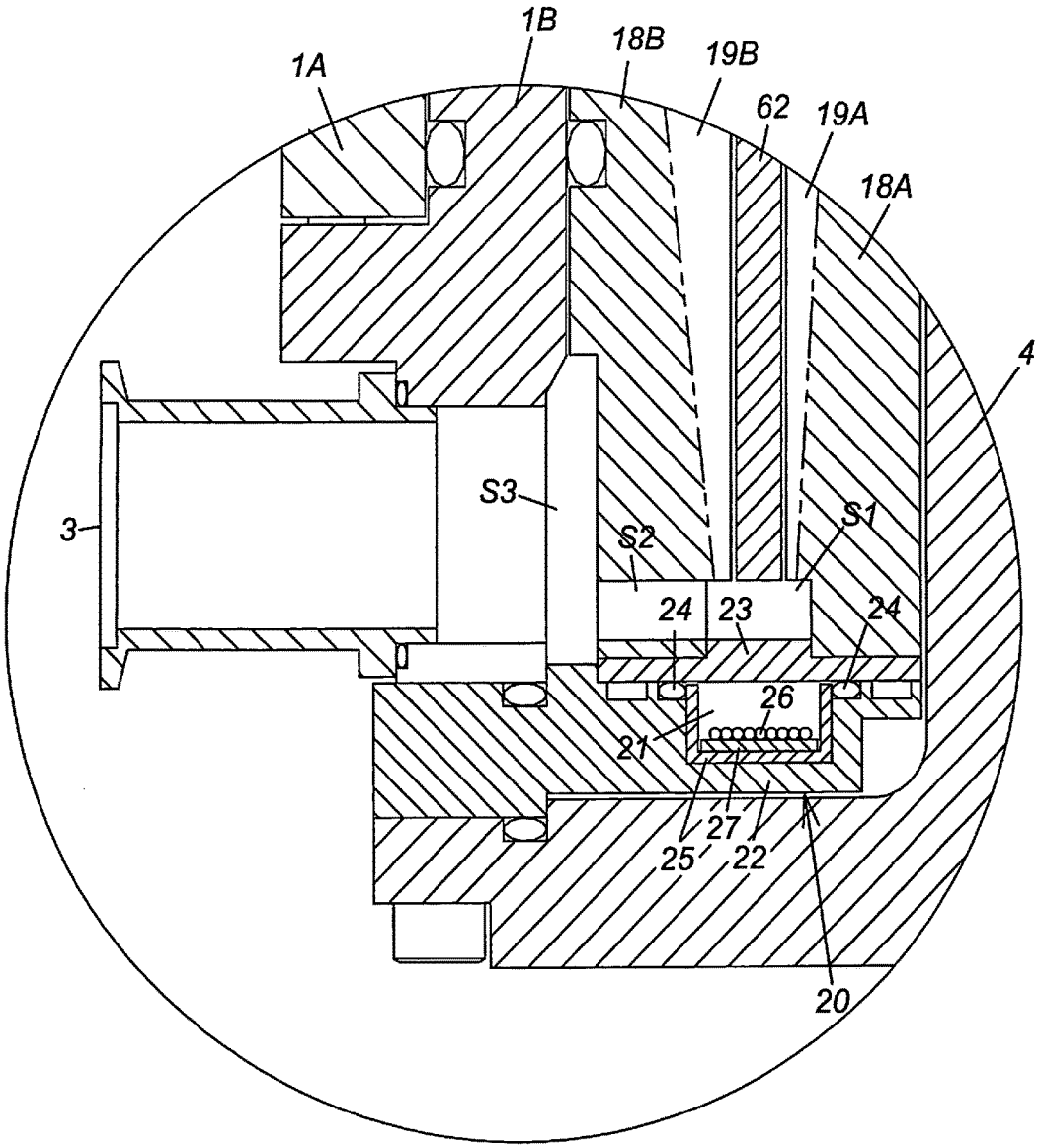

[FIG.4]
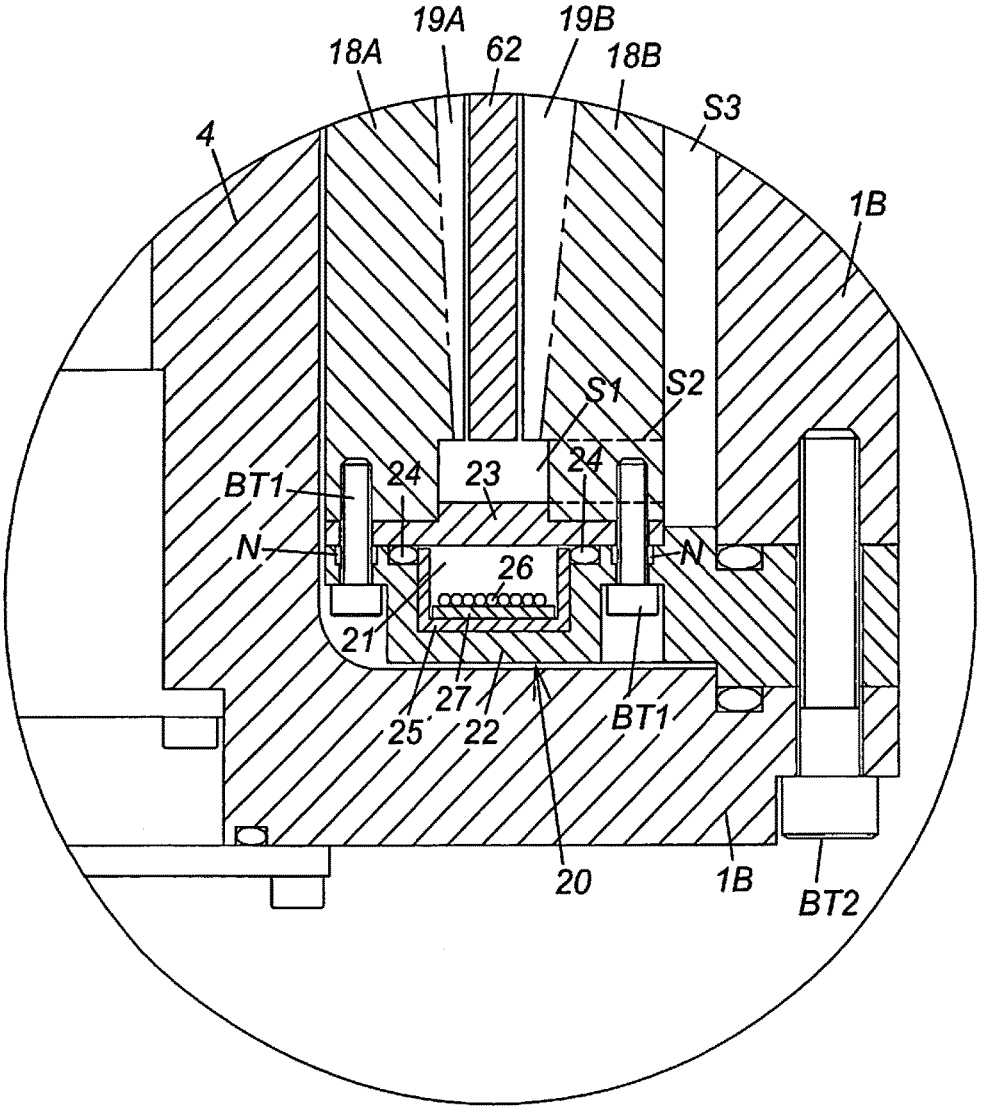

[FIG.5]
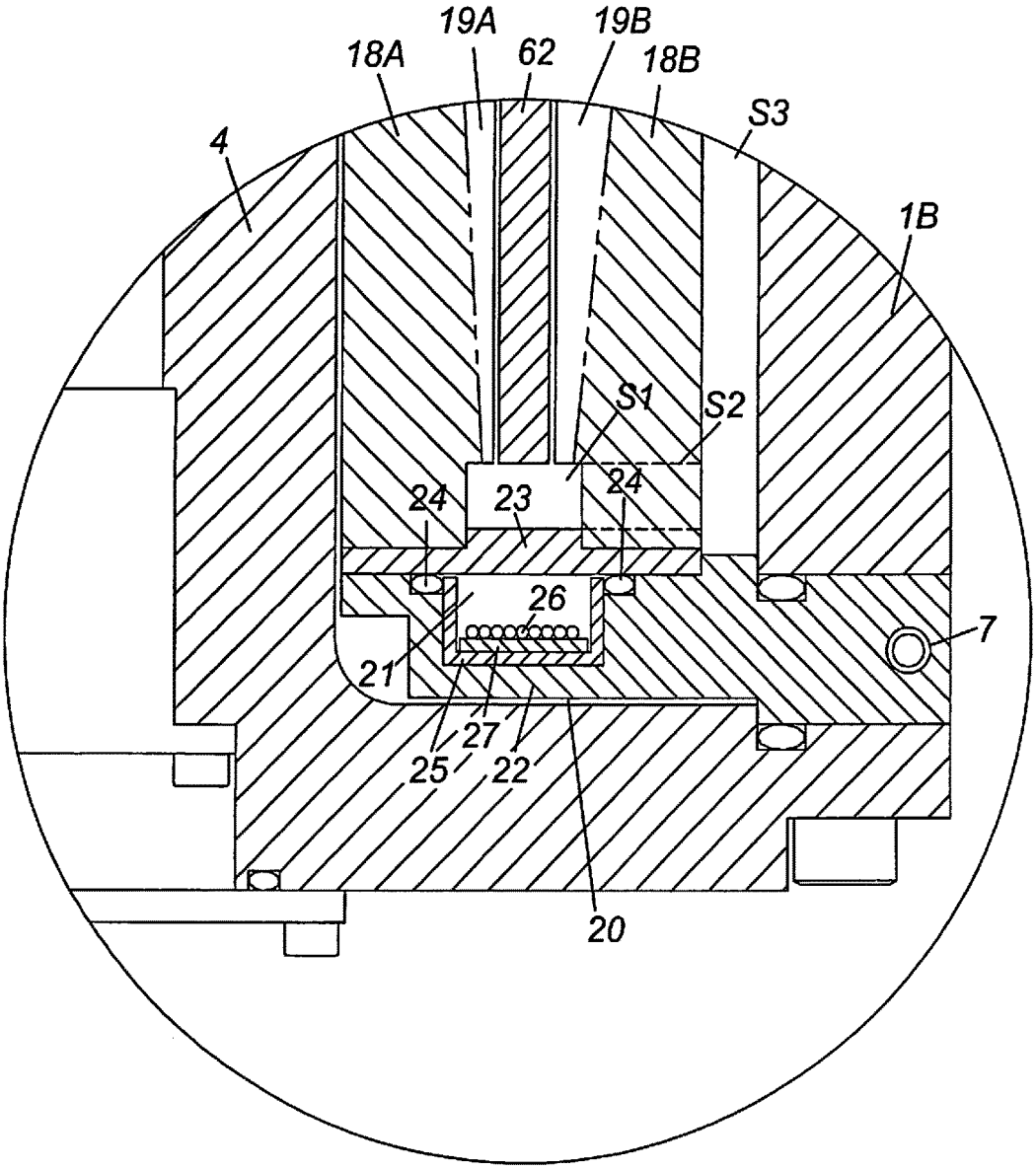

[FIG.6]
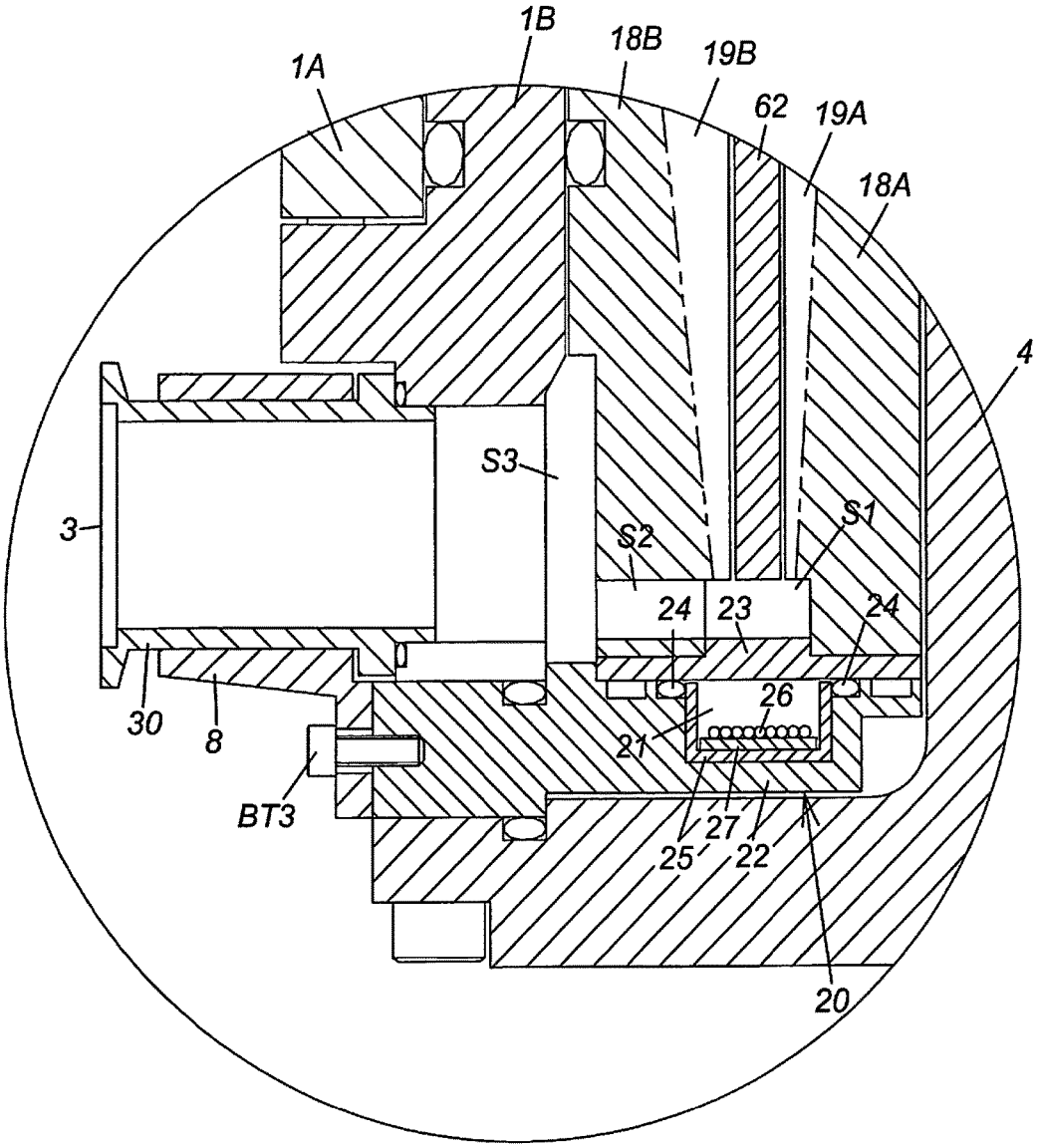

[FIG.7]
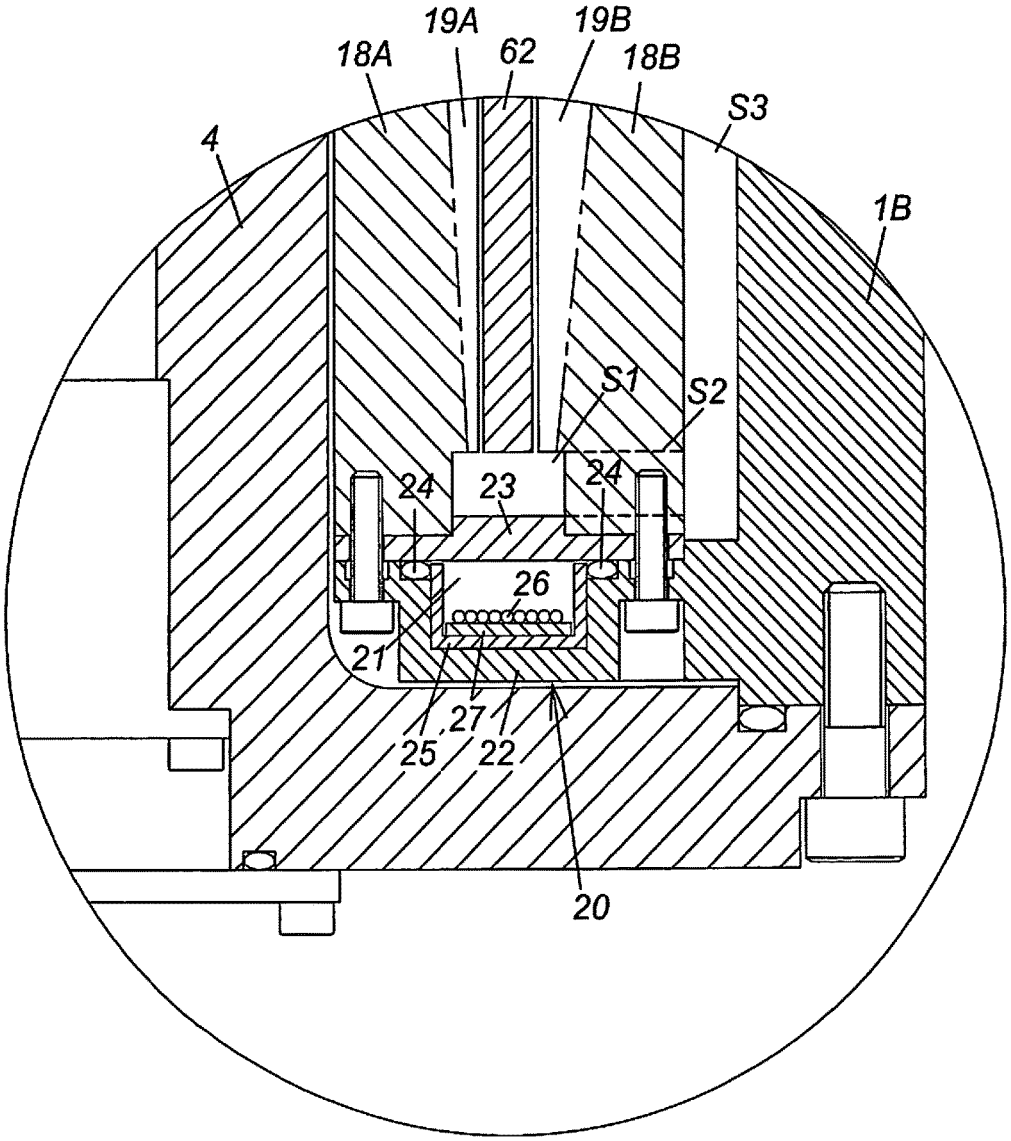

[FIG.8]
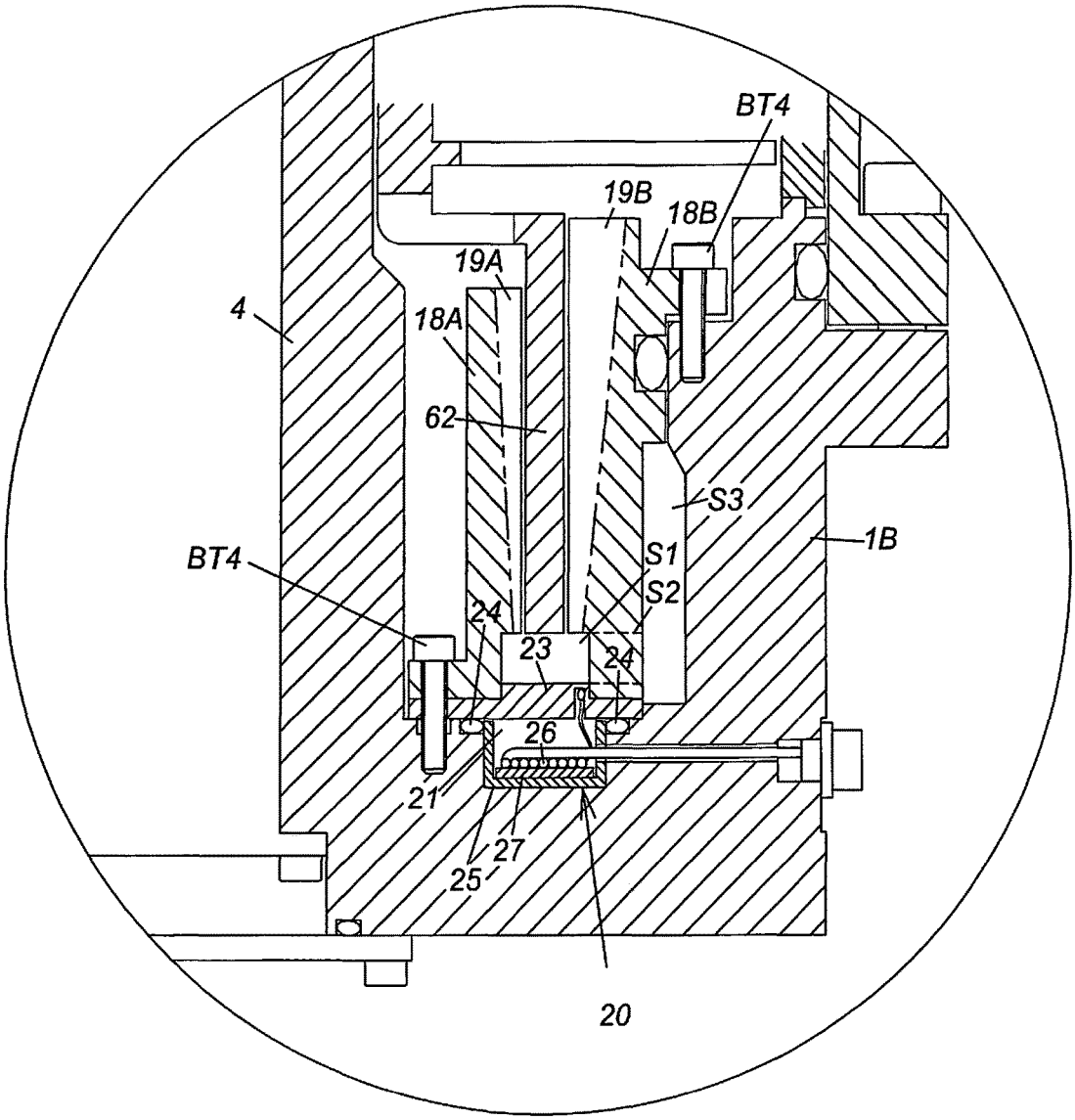

[FIG.9]
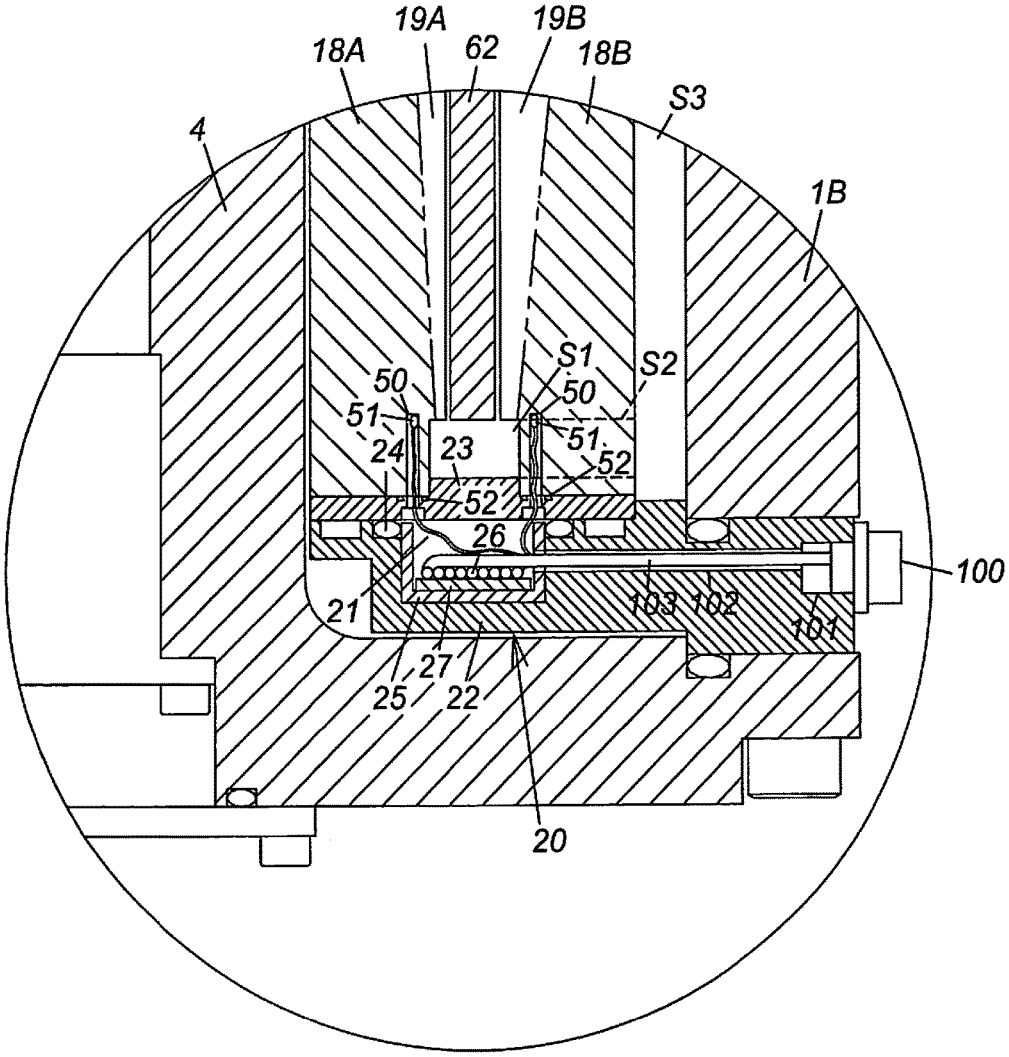

[FIG.10]
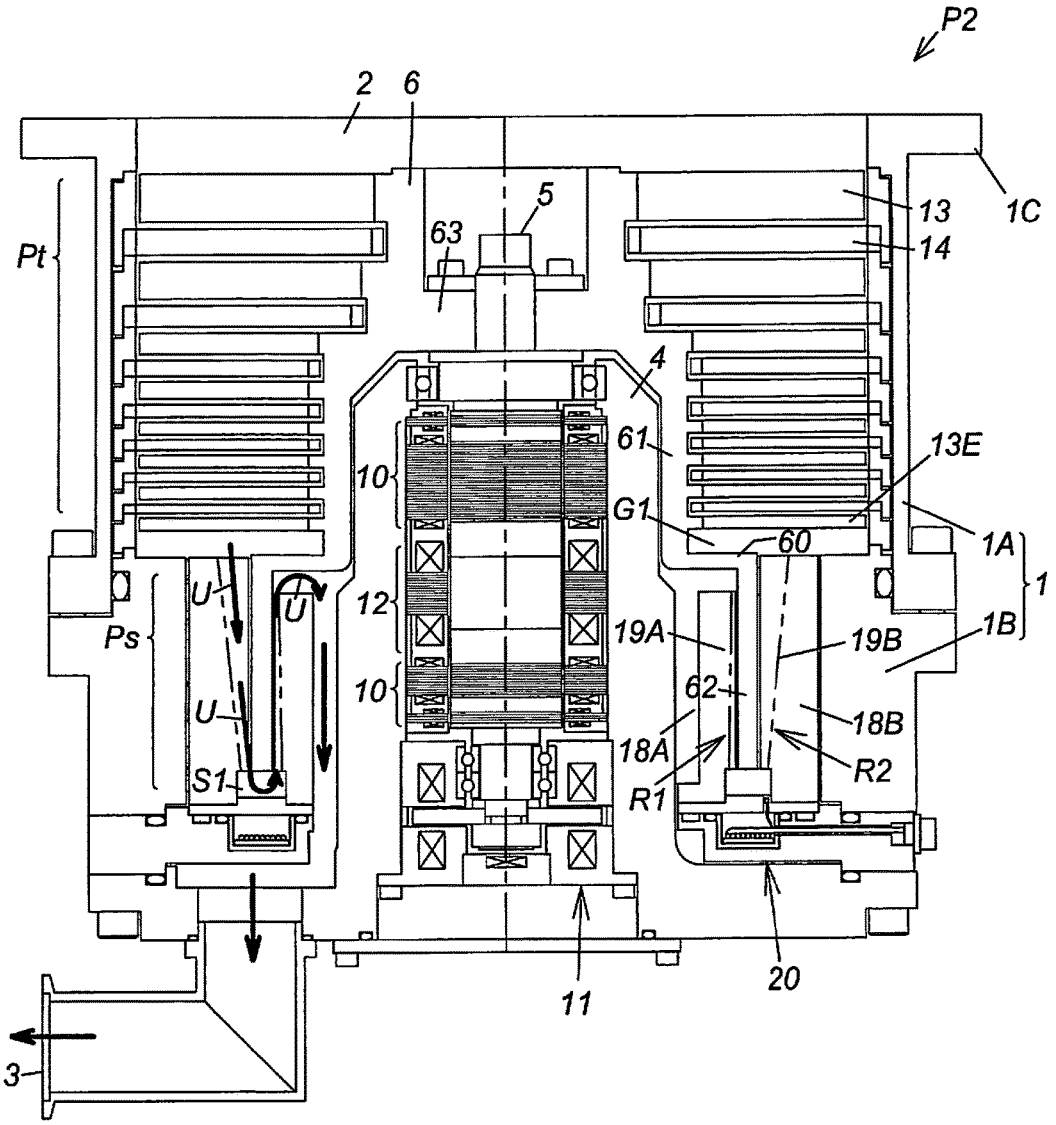

[FIG.11]
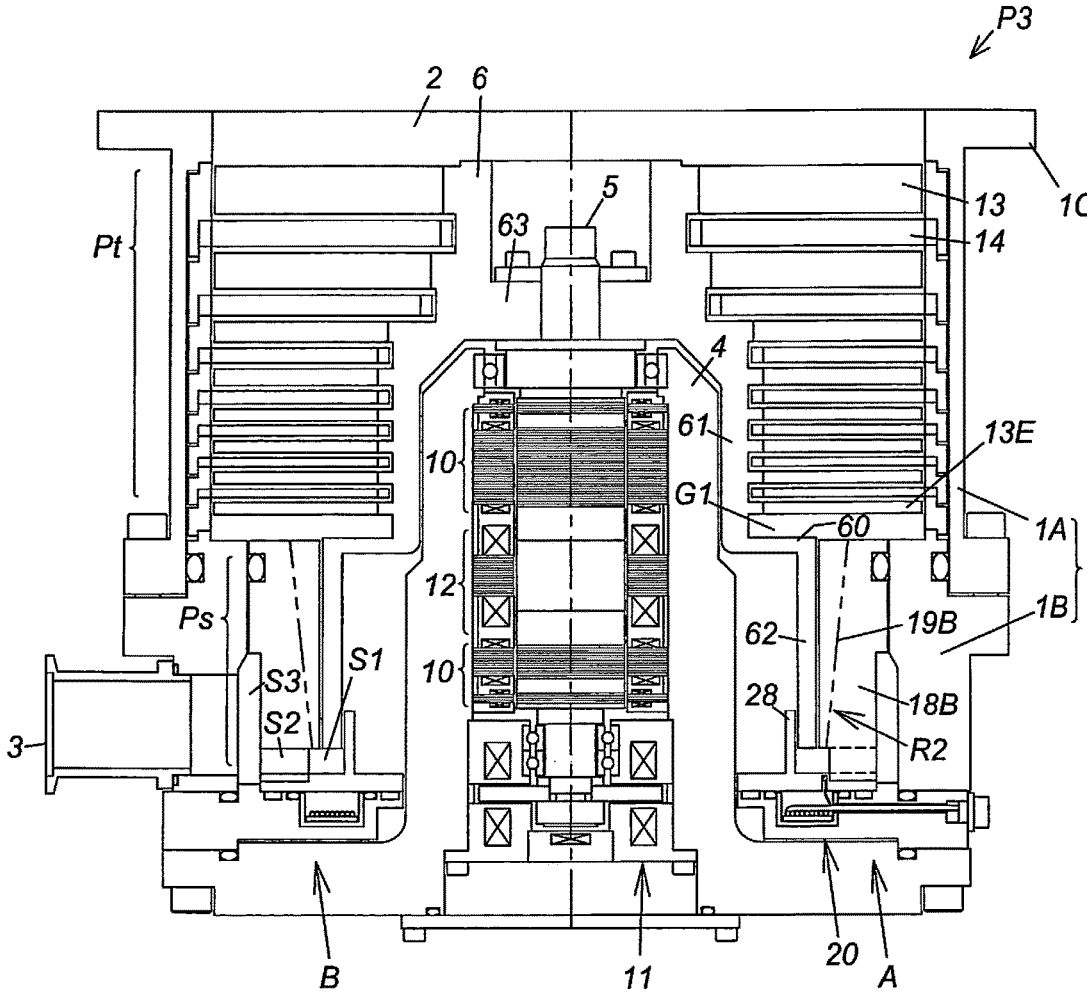

[FIG.12]
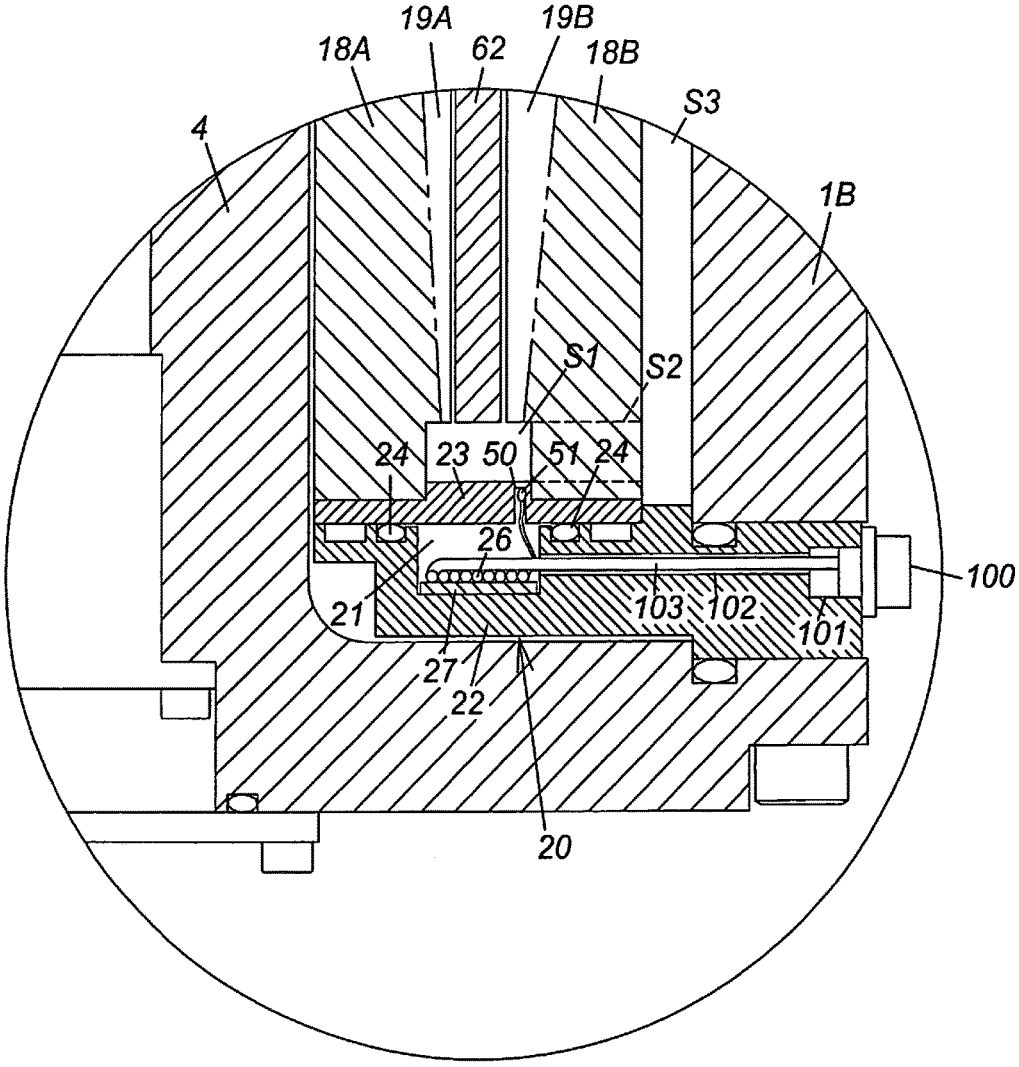

[FIG.13]
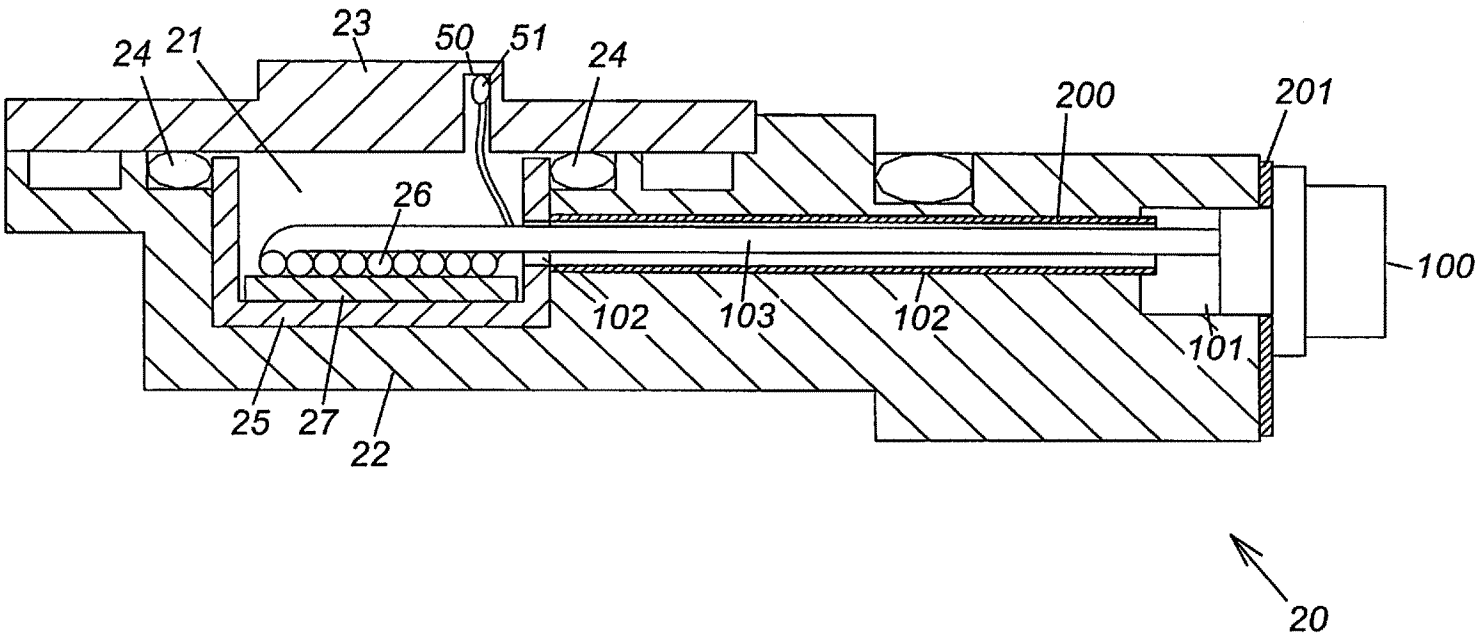

[FIG.14]
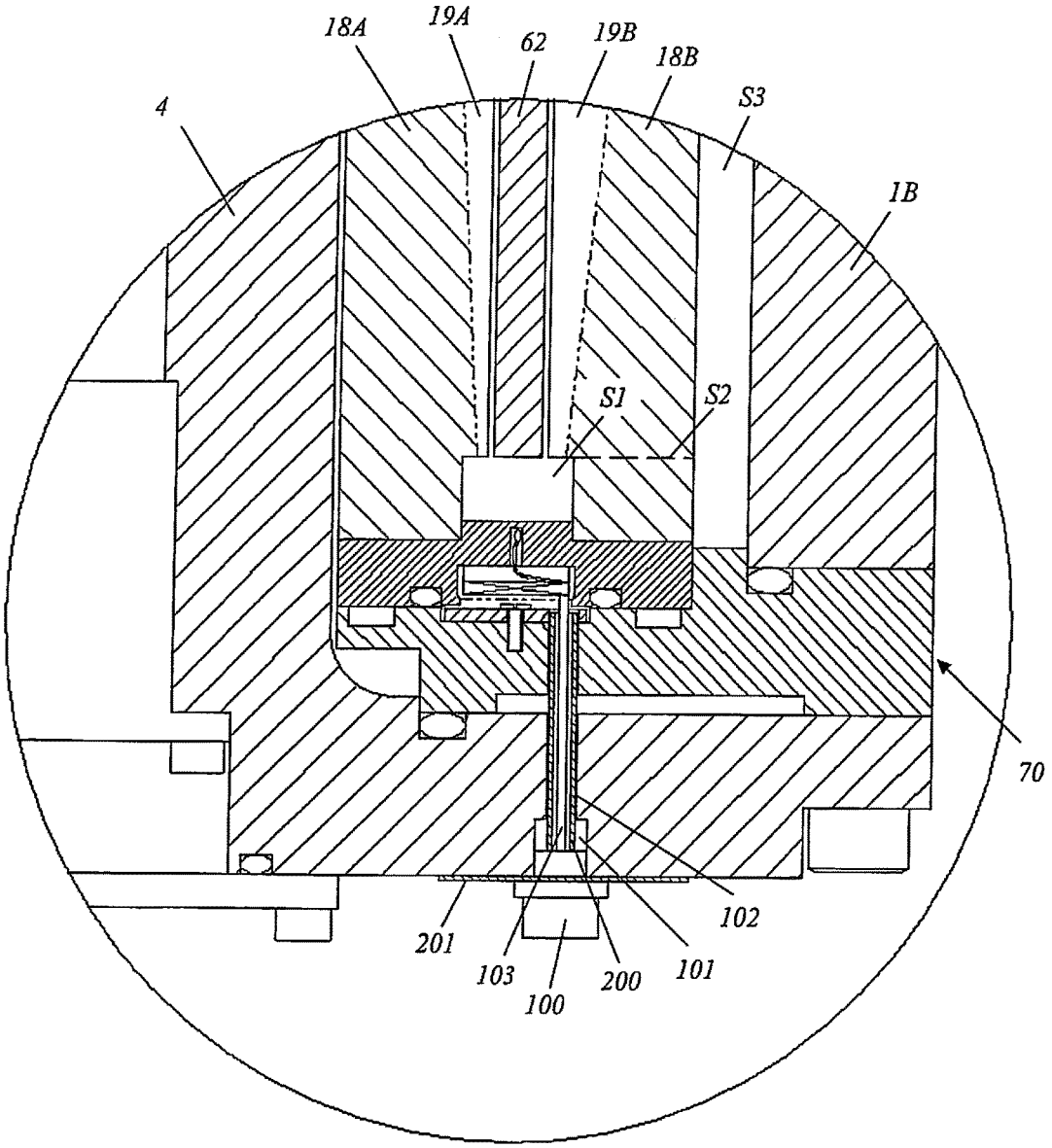

[FIG.15]
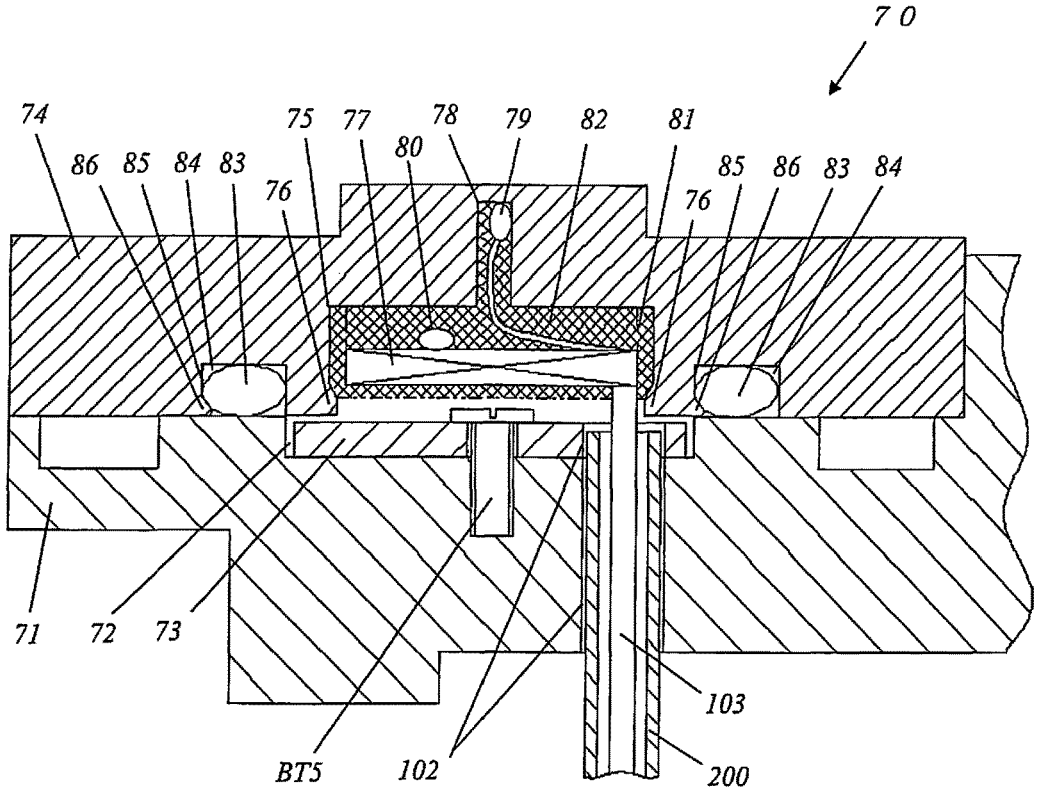
70 Heating portion
71 Heater spacer
72 Recess
73 Yoke
74 Heating plate
75 Groove
76 Protrusion portion
77 Coil
78 Sensor attachment hole
79 Temperature sensor
80 Temperature sensor
81 Insulating plate
82 Resin
83 O-ring
84 O-ring groove
85 Minimum diameter portion
86 Protrusion portion
BT5 Fastening bolt

[FIG.16]
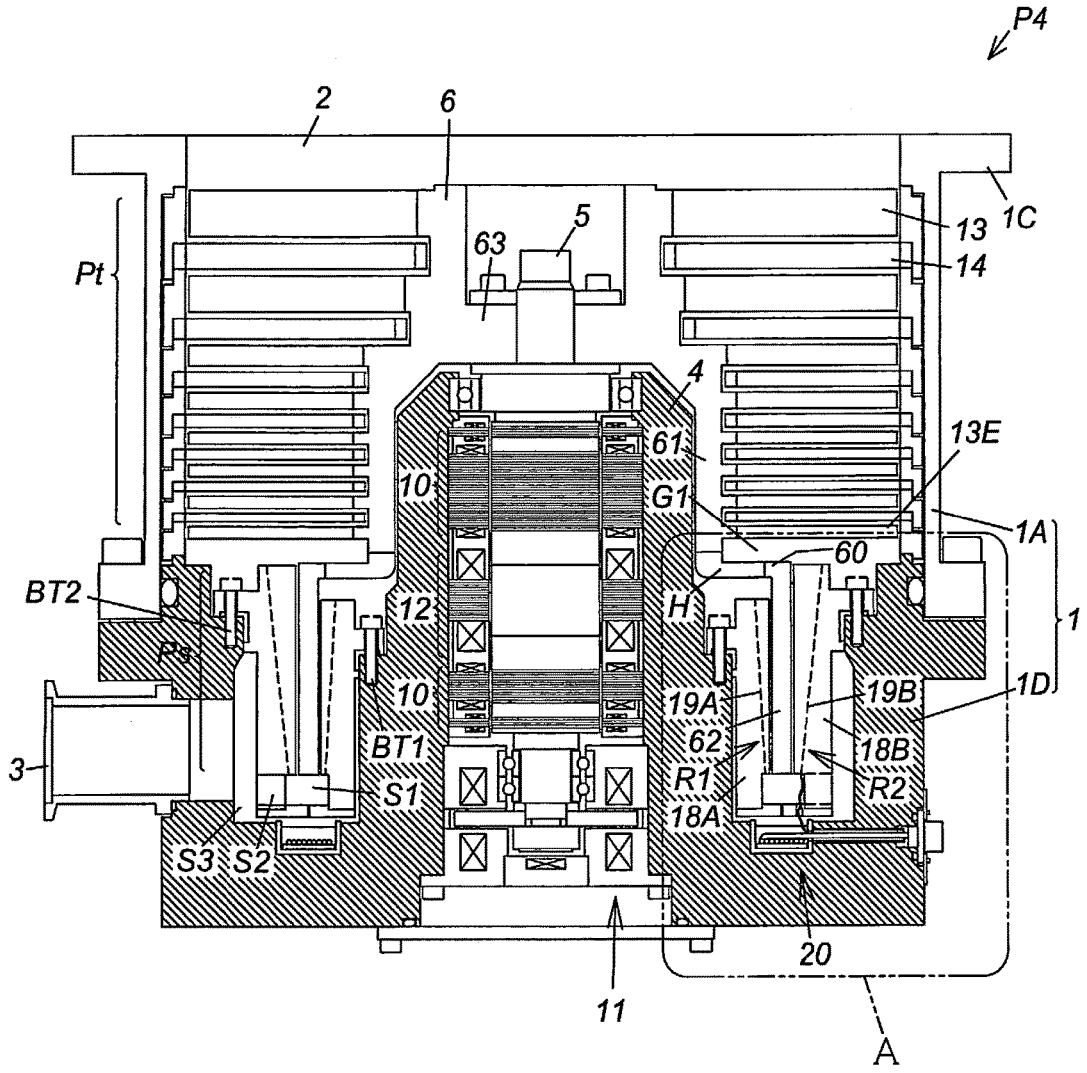

[FIG.17]
(a)
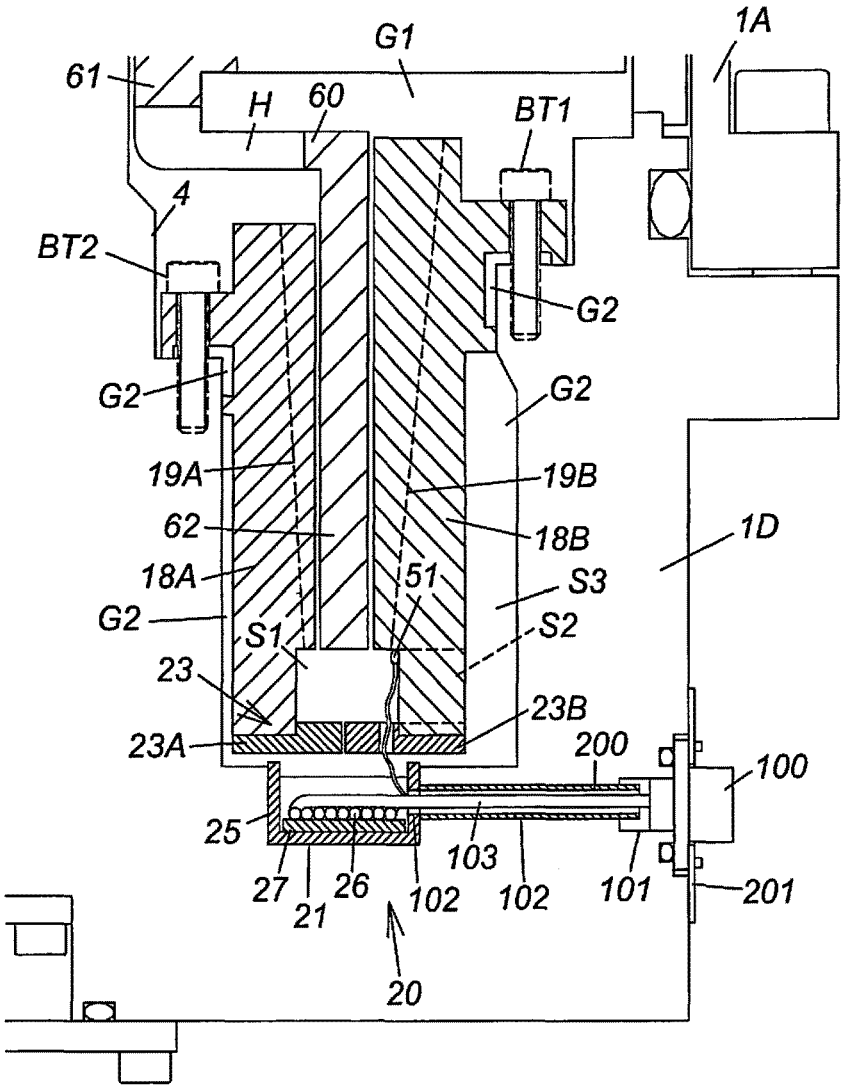
(b)
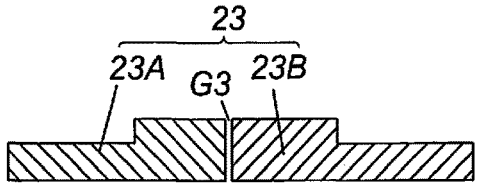

[FIG.18]
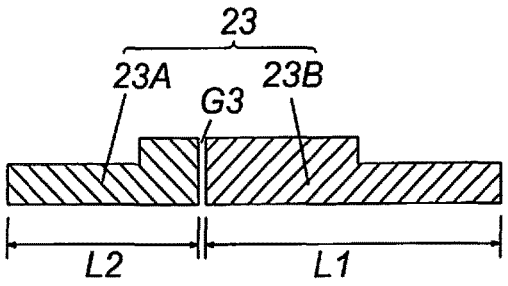
[FIG.19]
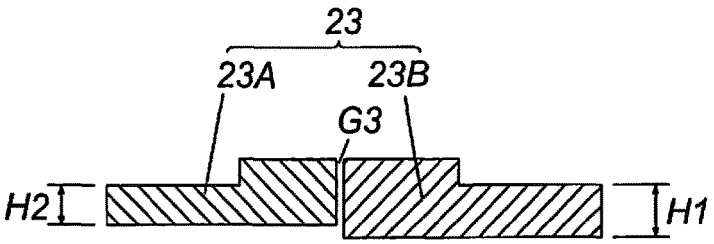
[FIG.20]
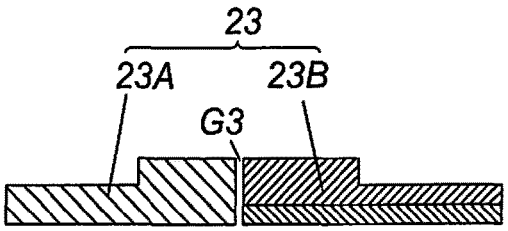

[FIG.21]
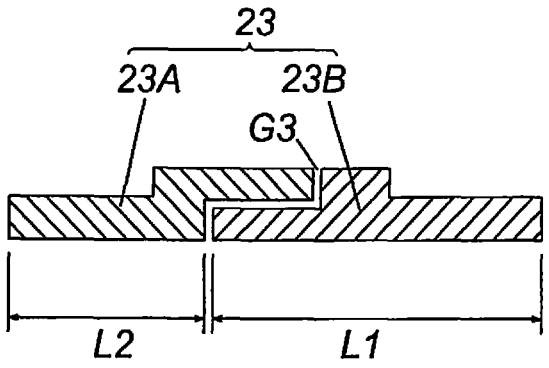
[FIG.22]
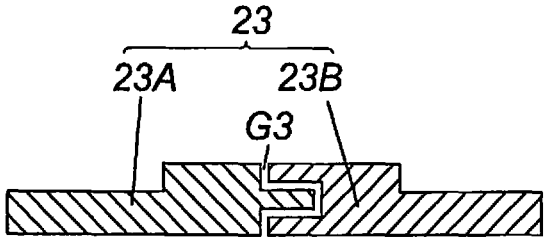

VACUUM PUMP

CROSS-REFERENCE TO RELATED APPLICATION

This application is a Section 371 National Stage Application of International Application No. PCT/JP2013/084634, filed Dec. 25, 2013, which is incorporated by reference in its entirety and published as WO 2014/119191 A1 on Aug. 7, 2014, not in English, and which claims priority to Japanese Patent Applications 2013-017234 filed on Jan. 31, 2013 and 2013-025936, filed on Feb. 13, 2013.

BACKGROUND

The present invention relates to a vacuum pump used as gas exhaust units and the like of process chambers and other sealed chambers in a semiconductor manufacturing apparatus, a flat panel display manufacturing apparatus, and a solar panel manufacturing apparatus.

As the vacuum pump of this type, for example, a vacuum pump described in Japanese Patent Application Laid-Open No. 2002-21775 has been publicly known. In the vacuum pump descried in Japanese Patent Application Laid-Open No. 2002-21775 (hereinafter referred to as "conventional vacuum pump"), as a means for preventing adhesion of a product in the pump, an alternating current is fed to a coil (25) illustrated in FIG. 2 of Japanese Patent Application Laid-Open No. 2002-21775 to raise the temperatures of a good heat conductor (24) and a heat radiation plate (20) and heat gas channels of a moving blade (5), a stationary blade (4), and a thread groove pump stage (9) through the heat radiation plate (20).

However, in the conventional vacuum pump, although the gas channels of the moving blade (5), the stationary blade (4), and the thread groove pump stage (9) can be heated as explained above, a lower side in a casing (1) cannot be heated (see FIG. 2 of Japanese Patent Application Laid-Open No. 2002-21775). Therefore, there is a problem in that the product easily adheres to the lower side in the casing (1) and an adhesion amount of the product in the vacuum pump as a whole is relatively large.

With the conventional vacuum pump, as illustrated in FIG. 2 of Japanese Patent Application Laid-Open No. 2002-21775, the coil (25) is housed in the good heat conductor (24) and a wire of the coil (25) is connected to a connector (26) piercing through the good heat conductor (24). Therefore, it is also likely that a trouble of a vacuum pump electric system due to magnetic flux leak occurs, for example, magnetic flux leaks from a through-hole (a hole through which the wire of the coil (25) is inserted) of the good heat conductor (24) and the wire of the coil (25) and electric components inside the vacuum pump malfunction because of the leaked magnetic flux.

Incidentally, in the conventional vacuum pump, gas in a gas inlet port (2) flows in the direction of an outlet port (3) through the gas channels of the moving blade (5), the stationary blade (4), and the thread groove pump stage (9), whereby the inlet port (2) side changes to a high vacuum and, on the other hand, the outlet port (3) side changes to a low vacuum (see the description of paragraph 0052 of Japanese Patent Application Laid-Open No. 2002-21775). When the outlet port (3) side changes to the low vacuum, a downstream side of the thread groove pump stage (9) close to the outlet port (3) also changes to the low vacuum.

However, with the conventional vacuum pump, as explained above, since the coil (25) is disposed downstream of the thread groove pump stage (9) that changes to the low vacuum (see FIG. 2 of Japanese Patent Application Laid-Open No. 2002-21775), insulating coating breakage of the coil (25) due to vacuum electric discharge occurs and the life of the coil (25) is short. There is also a problem in that a failure of the pump electric system such as a short circuit due to the insulating coating breakage of the coil (25) occurs and the vacuum pump cannot be stably continuously operated for a long period.

In the conventional vacuum pump, the connector (26) is attached to the lower outer circumference of the casing (1), the connector (26) and the coil (25) are connected by a wire (no reference numeral), and an alternating current is fed from the connector (26) to the coil (25) via the wire (see FIG. 2 of Japanese Patent Application Laid-Open No. 2002-21775).

However, with the conventional vacuum pump, an end side of the connector (26), in particular, a side to which the wire is connected is disposed in a vacuum in the casing (1) (see FIG. 2 of Japanese Patent Application Laid-Open No. 2002-21775). Therefore, an expensive vacuum connector has to be used as the connector (25) (see the description of paragraph 0051 of Japanese Patent Application Laid-Open No. 2002-21775). There is also a problem in that costs of the vacuum pump as a whole are inevitably high.

The discussion above is merely provided for general background information and is not intended to be used as an aid in determining the scope of the claimed subject matter. The claimed subject matter is not limited to implementations that solve any or all disadvantages noted in the background.

SUMMARY

The present invention has been devised in order to solve the problems and it is an object of the present invention to reduce an adhesion amount of a product in a vacuum pump as a whole and effectively prevent a trouble of a vacuum pump electric system due to a magnetic flux leak. It is another object of the present invention to enable stable continuous operation of the vacuum pump for a long period and reduce costs of the vacuum pump as a whole.

In order to attain the object, according to a first invention, there is provided a vacuum pump including: a rotor enclosed in a pump case; a rotating shaft fixed to the rotor; a supporting means that rotatably supports the rotating shaft; a driving means that rotates the rotating shaft; and a thread-groove-exhaust-portion stator that forms a thread grove exhaust passage between the thread-groove-exhaust-portion stator and an outer circumferential side of or an inner circumferential side of the rotor. A heating portion is provided below the thread-groove-exhaust-portion stator. The heating portion includes a yoke, a coil, and a heating plate. The heating portion heats the yoke and the heating plate with electromagnetic induction heating by feeding an alternating current to the coil.

In the first invention, the rotor may be enclosed in a base spacer, a stator base may be disposed below the rotor, the heating portion may be provided between the thread-groove-exhaust-portion stator and the stator base and further include a heater spacer, and the heating plate may be in contact with the thread-groove-exhaust-portion stator and attached to the heater spacer, and at least one of the heater spacer, the thread-groove-exhaust-portion stator, the base spacer, and the stator bas may be heated by heating the yoke and the heating plate.

In the first invention, the heating portion may be configured by the heater spacer having a recess, the yoke disposed in the recess, the coil disposed on the yoke, and the heating plate that is in contact with the thread-groove-exhaust-portion stator and attached to the heater spacer to cover the recess.

In the first invention, the heating portion may be configured by the heater spacer having a recess, the yoke disposed in the recess, and the heating plate that has a groove and that is in contact with the thread-groove-exhaust-portion stator and attached to the heater spacer to cover the recess.

In the first invention, the heating portion may be configured by the heater spacer, the yoke attached to the heater spacer, the heating plate that has a groove and that is in contact with the thread-groove-exhaust-portion stator and attached to the heater spacer to enclose the yoke, and the coil disposed in the groove.

In the first invention, the vacuum pump may include: a connector mounting portion for mounting a connector on an outer side surface of the heater spacer; a wire through-hole formed in only the heater spacer or both of the heater spacer and the yoke and connecting with the connector mounting portion from the recess or the groove; and a wire inserted through the wire through-hole to connect the coil and the connector.

In the first invention, the heating portion may include: a temperature sensor attached to the heating plate, or the thread-groove-exhaust-portion stator, or the yoke; and a temperature control means that controls, on the basis of a detection value in the temperature sensor, the heating plate, or the thread-groove-exhaust-portion stator, or the yoke to have a predetermined temperature.

In the first invention, the heating portion may include: a temperature sensor attached to the coil; and a protection control means that controls, on the basis of a detection value in the temperature sensor, the coil not to have temperature exceeding a predetermined temperature.

In the first invention, as a means enabling the thread-groove-exhaust-portion stator to be heated preferentially over the base spacer and the stator base, a gap or an intermediate member having lower thermal conductivity may be disposed between the thread-groove-exhaust-portion stator and the base spacer or the stator base whereby the thread-groove-exhaust-portion stator and the base spacer or the stator base are not in direct contact with each other.

In the first invention, the heater spacer and the yoke may be integrally formed of a magnetic material.

In the first invention, the heater spacer and the base spacer may be integrally formed.

In the first invention, the stator base, the heater spacer, and the base spacer may be integrally formed.

In the first invention, the vacuum pump may adopt a configuration in which bolt through-holes are provided in the heater spacer, and the heating plate and the heater spacer and the heating plate are integrally attached to the thread-groove-exhaust-portion stator by fastening bolts inserted through the bolt through-holes, or a configuration in which bolt through-holes are provided in the thread-groove-exhaust-portion stator and the heating plate, and the thread-groove-exhaust-portion stator and the heating plate are integrally attached to the heater spacer by fastening bolts inserted through the bolt through-hole, or a configuration in which a bolt through-hole is provided in the thread-groove-exhaust-portion stator, and the thread-groove-exhaust-portion stator is attached to the base spacer or the stator base by a fastening bolt inserted through the bolt through-hole such that a lower end face of the thread-groove-exhaust-portion stator is in contact with the heating plate, and a configuration in which, as a means for enabling the thread-groove-exhaust-portion stator to be heated preferentially over the heater spacer, heat conduction from the heating plate to the heater spacer is reduced by providing a lightening portion near a boundary between the heater spacer and the heating plate.

In order to attain the object, according to a second invention, there is provided a vacuum pump including: a rotor enclosed in a pump case; a rotating shaft fixed to the rotor; a supporting means that rotatably supports the rotating shaft; a driving means that rotates the rotating shaft; and a thread-groove-exhaust-portion stator that forms a thread grove exhaust passage between the thread-groove-exhaust-portion stator and an outer circumferential side of or an inner circumferential side of the rotor. A heating portion is provided below the thread-groove-exhaust-portion stator. The heating portion includes a yoke, a coil, and a heating plate. The heating portion further includes a wire that connects the coil to a connector and a magnetic-flux-leak reducing means. The heating portion heats the yoke and the heating plate with electromagnetic induction heating by feeding an alternating current to the coil.

In the second invention, the rotor may be enclosed in a base spacer, a stator base may be disposed below the rotor, the heating portion may be provided between the thread-groove-exhaust-portion stator and the base stator and further include a heater spacer, the heating plate may be in contact with the thread-groove-exhaust-portion stator and attached to the heater spacer, the heating portion may further include a wire through-hole formed in only the heater spacer or both of the heater spacer and the yoke, the wire may be inserted through the wire through-hole, the magnetic-flux-leak reducing means may be mounted around the wire through-hole or the connector, the alternating-current may be fed from the connector via the wire, and the heating portion heats at least one of the heater spacer, the thread-groove-exhaust-portion stator, the base spacer, and the stator base by heating the yoke and the heating plate.

In the second invention, the heating portion may be configured by the heater spacer having a recess, the yoke disposed in the recess, the coil disposed on the yoke, and the heating plate that is in contact with the thread-groove-exhaust-portion stator and attached to the heater spacer to cover the recess.

In the second invention, the heating portion may be configured by the heater spacer having a recess, the yoke disposed in the recess, and the heating plate that has a groove and that is in contact with the thread-groove-exhaust-portion stator and attached to the heater spacer to cover the recess.

In the second invention, the heating portion may be configured by the heater spacer, the yoke attached to the heater spacer, the heating plate that has a groove and that is in contact with the thread-groove-exhaust-portion stator and attached to the heater spacer to enclose the yoke, and the coil disposed in the groove.

In the first or second invention, the heating portion may further include a seal means for making it possible to set pressure inside the recess or the groove to an outside pressure.

In the first or second invention, the heating portion may include an elastic O-ring functioning as the seal means, an O-ring groove for attaching the O-ring to the heating plate, and a minimum diameter portion provided between an opening end face and a bottom surface of the O-ring groove, and the minimum diameter portion may function as an O-ring-drop preventing means for preventing the O-ring from dropping by being formed larger than an inner diameter of the O-ring or being configured by a protrusion portion provided at an edge of the O-ring groove.

In the first invention, the rotor may be enclosed in a pump base, the thread-groove-exhaust-portion stator may consist of: an outer thread-groove-exhaust-portion stator on an outer circumference side of the rotor; and an inner thread-groove-exhaust-portion stator on an inner circumference side of the rotor, the heating portion may be provided below the inner thread-groove-exhaust-portion stator and the outer thread-groove-exhaust-portion stator, the heating plate may be in contact with the inner thread-groove-exhaust-portion stator or the outer thread-groove-exhaust-portion stator, the yoke may be disposed in the pump base, the coil may be disposed on the yoke and have a function of heating at least any one of the inner thread-groove-exhaust-portion stator, the outer thread-groove-exhaust-portion stator, and the pump base by heating the heating plate and the yoke, and the heating plate may be separated into a plurality of heating plates as two or more separated heating plates.

The separated heating plates may have different material properties, and exhibit different heat values respectively.

The separated heating plates each may have an asymmetrical cross-sectional shape with respect to a gap portion formed by the separation, and exhibit different heating ranges and heat values respectively.

At least any one of the separated heating plates may be formed of a laminated material, whereby a heat value is different for each of the separated heating plates.

Separated portions of the separated heating plates may overlap in a vertical direction and formed in a bent passage shape.

In the first invention, in the pump base, a recess in which the yoke is disposed, a connector mounting portion for mounting a connector, a wire through-hole that is connected with the recess from the connector mounting portion, and a wire inserted through the wire through-hole to connect the coil and the connector may be provided.

In the first or second invention, the vacuum pump may include a magnetic-flux-leak reducing means amounted around the wire through-hole or the connector.

The magnetic-flux-leak reducing means may be a shield pipe mounted in the wire through-hole.

The magnetic-flux-leak reducing means may be a shield plate mounted around the connector.

In the second invention, the rotor may be enclosed in a pump base, the thread-groove-exhaust-portion stator may consist of: an outer thread-groove-exhaust-portion stator on an outer circumference side of the rotor; and an inner thread-groove-exhaust-portion stator on an inner circumference side of the rotor, the heating portion may be provided below the inner thread-groove-exhaust-portion stator and the outer thread-groove-exhaust-portion stator, the heating plate may be in contact with the inner thread-groove-exhaust-portion stator or the outer thread-groove-exhaust-portion stator, the yoke may be disposed in the pump base, the coil may be disposed on the yoke and have a function of heating at least any one of the inner thread-groove-exhaust-portion stator, the outer thread-groove-exhaust-portion stator, and the pump base by heating the heating plate and the yoke, a connector mounting portion for mounting the connector may be provided in the pump base, the magnetic-flux-leak reducing means may be a shield pipe formed of a magnetic material, and the wire is covered with the shield pipe.

A shield plate formed of a magnetic material may be set around the connector.

In the present invention, as explained above, the heating portion is provided below the thread-groove-exhaust-portion stator and, as a specific configuration of the heating portion, the vacuum pump adopts a configuration in which the yoke and the heating plate are heated by the electromagnetic induction heating by feeding the alternating current to the coil to heat members around the lower part of the thread-groove-exhaust-portion stator such as the heater spacer, the thread-groove-exhaust-portion stator, the base spacer, and the stator base. Consequently, adhesion of a product in the base spacer and the stator base can be prevented by the heating of the base spacer and the stator base by the heating portion. Therefore, it is possible to reduce an adhesion amount of the product in the vacuum pump as a whole.

In particular, according to second invention, as the specific configuration of the heating portion, the vacuum pump adopts the configuration including the coil and including the magnetic-flux-leak reducing means. Therefore, a magnetic flux leak of the coil can be reduced by the magnetic-flux-leak reducing means. It is possible to effectively prevent a trouble of a vacuum pump electric system due to the magnetic flux leak such as a malfunction of electric components inside the vacuum pump due to leaked magnetic flux.

In the specific configuration of the heating portion, with the configuration including the seal means for making it possible to set the inside of the recess or the groove to the outside pressure, the inside of the recess or the groove can be set to the outside pressure that does not cause vacuum electric discharge such as the atmospheric pressure or pressure close to the atmospheric pressure. Consequently, it is possible to prevent insulating coating breakage of the coil due to the vacuum electric discharge and attain extension of the life of the coil. It is possible to prevent a failure of the electric system of the vacuum pump such as a short circuit due to the insulating coating breakage of the coil. Therefore, it is possible to stably continuously operate the vacuum pump for a long period.

Further, with the configuration including the seal means, the inside of the recess or the groove can be set to, for example, the atmospheric pressure or the pressure close to the atmospheric pressure. Therefore, when a connector is connected to the coil in the recess or the groove via the wire, it is unnecessary to use an expensive vacuum connector as the connector. An inexpensive connector can be used. Therefore, it is possible to attain a reduction in costs of the vacuum pump as a whole.

The Summary is provided to introduce a selection of concepts in a simplified form that are further described in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 1 is a cross-sectional view of a vacuum pump (a thread groove pump parallel flow type) according to a first embodiment of the present invention;

FIG. 2 is an enlarged view of an A part of FIG. 1;

FIG. 3 is an enlarged view of a B part of FIG. 1;

FIG. 4 is an explanatory diagram of an attachment structure example of a heating portion;

FIG. 5 is an explanatory diagram of a structure example in which a cooling unit is provided in the heating portion;

FIG. 6 is an explanatory diagram of a structure example in which adhesion of a product in an outlet port is prevented by heating;

FIG. 7 is an explanatory diagram of a structure example in which a heater spacer and a base spacer of the heating portion are integrated;

FIG. 8 is an explanatory diagram of a structure example in which the heater spacer, the base spacer, and a stator spacer of the heating portion are integrated;

FIG. 9 is an explanatory diagram of another attachment example of a temperature sensor;

FIG. 10 is a cross-sectional view of a vacuum pump (a thread groove pump return flow type) according to a second embodiment of the present invention;

FIG. 11 is a cross-sectional view of a vacuum pump (a thread groove pump single flow type) according to a third embodiment of the present invention;

FIG. 12 is an explanatory diagram of a structure example in which a yoke of a heating portion is omitted;

FIG. 13 is an explanatory diagram of a structure example in which a magnetic flux leak of a coil can be more effectively reduced;

FIG. 14 is an explanatory diagram of another example of the structure of the heating portion;

FIG. 15 is a partial enlarged view of the heating portion shown in FIG. 14;

FIG. 16 is a cross-sectional view of a vacuum pump (a thread groove pump parallel flow type) according to a fourth embodiment of the present invention;

FIG. 17A is an enlarged view of an A part of FIG. 16, and FIG. 17B is an enlarged view of a heating plate;

FIG. 18 is an explanatory diagram of another embodiment concerning separation of the heating plate;

FIG. 19 is an explanatory diagram of another embodiment concerning the separation of the heating plate;

FIG. 20 is an explanatory diagram of another embodiment concerning the separation of the heating plate;

FIG. 21 is an explanatory diagram of another embodiment concerning the separation of the heating plate; and FIG. 22 is an explanatory diagram of another embodiment concerning the separation of the heating plate.

DETAILED DESCRIPTION

Preferred embodiments of the present invention are explained in detail below with reference to the accompanying drawings.

FIG. 1 is a cross-sectional view of a vacuum pump (a thread groove pump parallel flow type) according to a first embodiment of the present invention. FIG. 2 is an enlarged view of an A part of FIG. 1. FIG. 3 is an enlarged view of a B part of FIG. 1.

A vacuum pump P1 shown in FIG. 1 is used as a gas exhaust unit and the like of process chambers and other sealed chambers in a semiconductor manufacturing apparatus, a flat panel display manufacturing apparatus, and a solar panel manufacturing apparatus. The vacuum pump P1 includes, in an armor case 1, a blade exhaust section Pt that exhausts gas with rotary blades 13 and fixed blades 14, a thread groove exhaust section Ps that exhausts gas using thread grooves 19A and 19B, and a driving system for the blade exhaust section Pt and the thread groove exhaust section Ps.

The armor case 1 is formed in a cylindrical shape obtained by integrally coupling a cylindrical pump case 1A and a base spacer 1B using fastening bolts in a cylinder axial direction of the pump case 1A and the base spacer 1B. An upper end side of the pump case 1A is opened as a gas inlet port 2. A gas outlet port 3 is provided on a lower end side surface of the base spacer 1B.

The gas inlet port 2 is connected to a not-shown sealed chamber in a high vacuum such as a process chamber of a semiconductor manufacturing apparatus by not-shown fastening bolts provided in a flange 1C at the upper edge of the pump case 1A. The gas outlet port 3 is connected to a not-shown auxiliary pump.

A cylindrical stator base 4 incorporating various electric components is provided in the center in the pump case 1A. The stator base 4 is integrally erected on the inner bottom of the base spacer 1B. However, as another embodiment, for example, the stator base 4 may be formed as a component separate from the base spacer 1B and threaded and fixed to the inner bottom of the base spacer 1B.

A rotating shaft 5 is provided on the inner side of the stator base 4. The rotating shaft 5 is disposed such that the upper end thereof faces the direction of the gas inlet port 2 and the lower end thereof faces the direction of the base spacer 1B. The upper end of the rotating shaft 5 is provided to project upward from a cylindrical upper end face of the stator base 4.

The rotating shaft 5 is supported rotatably in a radial direction and an axial direction by two sets of radial magnetic bearings 10 and one set of an axial magnetic bearing 11 functioning as a supporting means. In this state, the rotating shaft 5 is driven to rotate by a driving motor 12 functioning as a driving unit. The supporting means (the radial magnetic bearings 10 and the axial magnetic bearing 11) and the driving unit (the driving motor 12) are housed in the stator base 4. Note that the radial magnetic bearings 10, the axial magnetic bearing 11, and the driving motor 12 are publicly known. Therefore, specific detailed explanation thereof is omitted.

A rotor 6 is provided on the outer side of the stator base 4. The rotor 6 is enclosed in the pump case 1A and the base spacer 1B. The rotor 6 is formed in a cylindrical shape surrounding the outer circumference of the stator base 4 and in a shape obtained by coupling two cylinder bodies (a first cylinder body 61 and a second cylinder body 62), which have different diameters, in a cylinder axis direction thereof using a coupling section 60 of an annular plate body located substantially in the middle of the rotor 6.

At the upper end of the first cylinder body 61, as a member configuring an upper end surface thereof, an end member is integrally provided. The rotor 6 is fixed to the rotating shaft 5 via the end member 63. The rotor 6 is rotatably supported around the axis thereof (the rotating shaft 5) by the radial magnetic bearings 10 and the axial magnetic bearing 11 via the rotating shaft 5.

The rotor 6 in the vacuum pump P1 shown in FIG. 1 is cut out from one aluminum alloy ingot. Therefore, the first cylinder body 61, the second cylinder body 62, the coupling section 60, and the end member 63 configuring the rotor 6 are formed as one component. However, as another embodiment, it is also possible to adopt a rotor in which the first cylinder body 61 and the second cylinder body 62 are configured as separate components on both sides of the coupling section 60. In this case, the first cylinder body 61 and the second cylinder body 62 may be formed of different materials, for example, the first cylinder body 61 is formed of a metal material such as an aluminum alloy and the second cylinder body 62 is formed of resin.

<<Detailed Configuration of the Blade Exhaust Section Pt>>

In the vacuum pump P1 shown in FIG. 1, an upstream side of substantially the middle of the rotor 6 (specifically, the coupling section 60) (a range from substantially the middle of the rotor 6 to the gas inlet port 2 side end of the rotor 6) functions as the blade exhaust section Pt. The blade exhaust section Pt is explained in detail.

A plurality of rotary blades 13 are integrally provided on the outer circumferential surface of the rotor 6 further on the upstream side than substantially the middle of the rotor 6, specifically, the outer circumferential surface of the first cylinder body 61 configuring the rotor 6. The plurality of rotary blades 13 are radially disposed side by side centering on the rotation center axis (the rotating shaft 5) of the rotor 6 or the axis of the armor case 1 (hereinafter referred to as "vacuum pump axis").

On the other hand, a plurality of fixed blades 14 are provided on the inner circumference side of the pump case 1A. The plurality of fixed blades 14 are also radially disposed side by side centering on the vacuum pump axis.

In the vacuum pump P1 shown in FIG. 1, the rotary blades 13 and the fixed blades 14 radially disposed as explained above are alternately disposed in multiple stages along the vacuum pump axis, whereby the blade exhaust section Pt of the vacuum pump P1 is configured.

Note that all the rotary blades 13 are blade-like cut products cut out integrally with an outer diameter machined section of the rotor 6. The rotary blades 13 are inclined at an angle optimum for exhaust of gas molecules. All the fixed blades 14 are also inclined at an angle optimum for exhaust of gas molecules.

<<Explanation of an Exhaust Operation by the Blade Exhaust Section Pt>>

In the blade exhaust section Pt configured as explained above, the rotating shaft 5, the rotor 6, and the plurality of rotary blades 13 integrally rotate at high speed according to the start of the driving motor 12. The rotary blade 13 at the top stage gives a momentum in the downward direction to gas molecules injected from the gas inlet port 2. The gas molecules having the momentum in the downward direction are sent by the fixed blades 14 to the rotary blade 13 side at the next stage. The giving of the momentum to the gas molecules and the sending action explained above are repeatedly performed in multiple stages, whereby the gas molecules on the gas inlet port 2 side are exhausted to sequentially shift toward downstream of the rotor 6.

<<Detailed Configuration of the Thread Groove Exhaust Section Ps>>

In the vacuum pump P1 shown in FIG. 1, a downstream side of substantially the middle of the rotor 6 (specifically, the coupling section 60) (a range from substantially the middle of the rotor 6 to the gas outlet port 3 side end of the rotor 6) functions as the thread groove exhaust section Ps. The thread groove exhaust section Ps is explained in detail below.

The rotor 6 further on the downstream side than substantially the middle of the rotor 6, specifically, the second cylinder body 62 configuring the rotor 6 is a portion that rotates as a rotating member of the thread groove exhaust section Ps. The second cylinder body 62 is inserted and housed, via a predetermined gap, between thread-groove-exhaust-portion stators 18A and 18B having an inner/outer double cylindrical shape of the thread groove exhaust section Ps.

The thread-groove-exhaust-portion stator 18A of the thread-groove-exhaust-portion stators 18A and 18B having the inner/outer double cylindrical shape is a cylindrical fixed member disposed such that the outer circumferential surface thereof are opposed to the inner circumferential surface of the second cylinder body 62. The thread-groove-exhaust-portion stator 18A is disposed to be surrounded by the inner circumference of the second cylinder body 62.

On the other hand, the thread-groove-exhaust-portion stator 18B on the outer side is a cylindrical fixed member disposed such that the inner circumferential surface thereof is opposed to the outer circumferential surface of the second cylinder body 62. The thread-groove-exhaust-portion stator 18B is disposed to surround the outer circumference of the second cylinder body 62.

In an outer circumferential section of the thread-groove-exhaust-portion stator 18A on the inner side, as a means for forming a thread groove exhaust passage R1 on the inner circumference side of the rotor 6 (specifically, on the inner circumference side of the second cylinder body 62), a thread groove 19A changing in a taper cone shape reduced in diameter downward is formed. The thread groove 19A is engraved in a spiral shape from the upper end to the lower end of the thread-groove-exhaust-portion stator 18A. A thread groove exhaust channel is formed on the inner circumference side of the second cylinder body 62 (hereinafter referred to as "inner thread groove exhaust channel R1") by the thread-groove-exhaust-portion stator 18A including the thread groove 19A. Note that, as shown in FIG. 2, the lower end of the thread-groove-exhaust-portion stator 18A on the inner side is supported by a heating plate 23.

In an inner circumferential section of the thread-groove-exhaust-portion stator 18B on the outer side, as a means for forming a thread groove exhaust passage R2 on the outer circumferential side of the rotor 6 (specifically, the outer circumference side of the second cylinder body 62), a thread groove 19B same as the thread groove 19A is formed. A thread groove exhaust channel is formed on the outer circumference side of the second cylinder body 62 (hereinafter referred to as "outer thread groove exhaust channel R2") by the thread-groove-exhaust-portion stator 18B including the thread groove 19B. Note that, as shown in FIG. 2, the lower end of the thread-groove-exhaust-portion stator 18B on the outer side is also supported by the heating plate 23.

Although not shown in the figure, the inner thread groove exhaust channel R1 or the outer thread groove exhaust channel R2 may be provided by forming the thread grooves 19A and 19B explained above on the inner circumferential surface or the outer circumferential surface or both of the surfaces of the second cylinder body 62.

In the thread groove exhaust section Ps, in order to transfer gas while suppressing the gas according to a drag effect in the thread groove 19A and on the inner circumferential surface of the second cylinder body 62 and a drag effect in the thread groove 19B and on the outer circumferential surface of the second cylinder body 62, the depth of the thread groove 19A is set to be the largest on an upstream inlet side of the inner thread groove exhaust channel R1 (a channel opening end closer to the gas inlet port 2) and the smallest on a downstream outlet side of the inner thread groove exhaust channel R1 (a channel opening end closer to the gas outlet port 3). The same applies to the thread groove 19B.

An upstream inlet of the outer thread groove exhaust channel R2 is connected with a gap between a rotary blade 13E at the bottom stage among the rotary blades 13 disposed in the multiple stages and an upstream end of a connection opening H explained below (hereinafter referred to as "final gap G1"). As shown in FIG. 3, a downstream outlet of the channel R2 is connected with the gas outlet port 3 side through an annular confluence channel S1, a lateral hole channel S2, and an annular confluence channel S3.

An upstream inlet of the inner thread groove exhaust channel R1 is opened toward the inner circumferential surface of the rotor 6 (specifically, the inner surface of the coupling section 60) substantially in the middle of the rotor 6. A downstream outlet of the channel R1 is connected with the gas outlet port 3 side through the annular confluence channel S1, the lateral hole channel S2, and the annular confluence channel S3.

The annular confluence channel S1 is formed to be connected with the downstream outlets of the inner and outer thread groove exhaust channels R1 and R2 and the lateral hole channel S2 by providing a predetermined gap between the end of the second cylinder body 62 and a heating portion 20 explained below (in the vacuum pump P1 shown in FIG. 1, a gap formed to turn around a lower part outer circumference of the stator base 4). The lateral hole channel S2 is formed to be connected with the annular confluence channel S1, the annular confluence channel S3, and the gas outlet port 3 by providing a plurality of cutouts at the end of the outer thread-groove-exhaust-portion stator 18B.

The connection opening H is opened substantially in the middle of the rotor 6. The connection opening H is formed to pierce through the front and rear surfaces of the rotor 6 to function to guide a part of gas present on the outer circumference side of the rotor 6 to the inner thread groove exhaust channel R1. The connection opening H having such a function may be formed to, for example, pierce through the inner and outer surfaces of the coupling section 60 as shown in FIG. 1. In the vacuum pump P1 shown in FIG. 1, a plurality of the connection openings H are provided. The plurality of connection openings H are disposed point-symmetrical with respect to the vacuum pump axis.

<<Explanation of an Exhaust Operation in the Thread Groove Exhaust Section Ps>>

The gas molecules reaching the upstream inlet of the outer thread groove exhaust channel R2 and the final gap G1 according to the transfer by the exhaust operation of the blade exhaust section Pt explained above shift to the inner thread groove exhaust channel R1 from the outer thread groove exhaust channel R2 and the connection opening H. The shifted gas molecules shift toward the annular confluence channel S1 while being compressed from a transitional flow into a viscous flow according to an effect generated by the rotation of the rotor 6, that is, a drag effect on the outer circumferential surface of the second cylinder body 62 and in the thread groove 19B and a drag effect on the inner circumferential surface of the second cylinder body 62 and in the thread groove 19A. The viscous flow of the gas molecules reaching the annular confluence channel S1 flows into the annular confluence channel S3 through the lateral hole channel S2 and flows into the gas outlet port 3. The viscous flow of the gas molecules is exhausted to the outside from the gas outlet port 3 through the not-shown auxiliary pump.

<<Explanation of the Heating Portion in the Vacuum Pump Shown in FIG. 1>>

In the vacuum pump P1 shown in FIG. 1, as a means for preventing adhesion of a product, the heating portion 20 is provided below the thread-groove-exhaust-portion stators 18A and 18B. Specifically, the heating portion 20 is provided between the thread-groove-exhaust-portion stators 18A and 18B and the stator base 4 disposed in the lower parts of the thread-groove-exhaust-portion stators 18A and 18B.

The heating portion 20 includes, as shown in FIG. 2, a heater spacer 22 including a recess 21, a yoke 25 disposed in the recess 21, a coil 26 disposed on the yoke 25, the heating plate 23 in contact with the thread-groove-exhaust-portion stators 18A and 18B and attached to the heater spacer 22 to cover the recess 21, and a seal means 24 capable of setting the inside of the recess 21 to an outside pressure.

The heating portion 20 heats the yoke 25 and the heating plate 23 with electromagnetic induction heating by feeding a high-frequency alternating current to the coil 26 to heat the heater spacer 22, the thread-groove-exhaust-portion stators 18A and 18B, the base spacer 1B, and the stator base 4.

The heater spacer 22 includes a connector mounting portion 101 for mounting a connector 100 on the outer side surface thereof, a wire through-hole 102 connecting with the connector mounting portion 101 from the recess 21, and a wire 103 of the coil 26 inserted through the wire through-hole 102 to connect the coil 26 and the connector 100. In the yoke 25 as well, the wire through-hole 102 is provided in order to insert the wire 103 of the coil 26 and a wire of a temperature sensor 51 explained below therethrough.

The connector 100, the connector mounting portion 101, the wire through-hole 102, the wire 103, and the wire of the temperature sensor 51 shown in FIG. 2 are disposed in horizontal positions (in directions facing the outer circumference of the base spacer 1B) but may be disposed in vertical positions (in a direction facing the bottom surface of the stator base 4) as shown in FIG. 14.

The seal means 24 seals an opening peripheral edge of the recess 21 with an O-ring or another seal member to thereby separate the recess 21 from a vacuum region such as the inner and outer thread groove exhaust channels R1 and R2 and make it possible to set only the inside of the recess 21 to the outside pressure.

The inside of the recess 21 is set to the atmospheric pressure when the atmosphere outside the heater spacer 22 is taken into the recess 21 via the wire through-hole 102. Note that it is also possible to take the outdoor air other than the atmosphere into the recess 21. The pressure in the recess 21 is not limited to the atmospheric pressure and only has to be pressure that does not cause insulting coating breakage of the coil 26 due to vacuum electric discharge.

The yoke 25 and the coil 26 are electrically insulated by an insulating plate 27 interposed between the yoke 25 and the coil 26. The heater spacer 22 is formed of an aluminum alloy. The heating plate 23 and the yoke 25 are formed of a magnetic material such as an iron-base material (e.g., pure iron, S15C, or S25C) or a stainless steel material having magnetism (e.g., a ferrite-base stainless steel material, SUS430, SUS304, or SUS420J2). The coil 26 is formed of a good conductor (e.g., a copper material).

When a high-frequency alternating current is fed to the coil 26, the coil 26, the heating plate 23, and the yoke 25 are electromagnetically coupled. An eddy current is generated on the insides of the heating plate 23 and the yoke 25. Then, since the heating plate 23 and the yoke 25 have peculiar electric resistances, Joule heat is generated in the heating plate 23 and the yoke 25. Iron loss heat generation occurs in the heating plate 23 and the yoke 25 and copper loss heat generation occurs in the coil 26. The thread-groove-exhaust-portion stators 18A and 18B and the heater spacer 22 are preferentially heated by these kinds of heat. Further, the base spacer 1B and the stator base 4 are also heated by heat conduction from the heater spacer 22.

The distance from the coil 26 to the heating plate 23 and the distance from the coil 26 to the yoke 25 equivalent to the thickness of the insulating plate 27 can be changed as appropriate according to necessity. However, from the viewpoint of preventing adhesion of a product on the thread-groove-exhaust-portion stator side, the distances are preferably set to distances with which the heating plate 23 can be more effectively heated than the yoke 25.

In the heating portion 20, the cross-sectional shape of the yoke 25 is formed in an upward groove shape toward the ends of the thread-groove-exhaust-portion stators 18A and 18B. The upper end of the yoke 25 is disposed close to the heating plate 23. Consequently, the coil 26 in the yoke 25 is disposed in a space surrounded by the heating plate 23 and the yoke 25. Therefore, a magnetic flux leak of the coil 26 decreases and improvement of heating efficiency is attained.

Further, the heating portion 20 includes the temperature sensor 51 attached to the heating plate 23 and a temperature control means (not shown in the figure) that controls, on the basis of a detection value in the temperature sensor 51, the heating plate 23 to have a predetermined temperature.

Further, the heating portion 20 may include a temperature sensor (not shown in the figure) attached to the coil 26 and a temperature control means (not shown in the figure) that controls, on the basis of a detection value in the temperature sensor 51, the coil 26 not to have temperature exceeding a predetermined temperature.

As a method of attaching the temperature sensor 51 to the heating plate 23, it is possible to adopt a method of forming a sensor attachment hole 50, which is opened only on the recess 21 side, in the heating plate 23 and inserting the temperature sensor 51 into the sensor attachment hole 50 and fixing the temperature sensor 51 with an adhesive or the like as shown in FIG. 2. A wire of the temperature sensor 51 is connected to the connector 100 from the sensor attachment hole 50 through the recess 21 and the wire through-hole 102.

In the vacuum pump P1 shown in FIG. 1, as a means for making it possible by the heating portion to heat the thread-groove-exhaust-portion stators 18A and 18B more preferentially than the base spacer 1B and the stator base 4, a gap or an intermediate member M made of an O-ring having lower thermal conductivity is formed between the outer thread-groove-exhaust-portion stator 18B and the base spacer 1B whereby the outer thread-groove-exhaust-portion stator 18B and the base spacer 1B or the stator base 4 are not n direct contact with each other. Note that a member other than the O-ring can be adopted as the intermediate member M.

FIG. 4 is an explanatory diagram of an attachment structure example of the heating portion.

In the vacuum pump P1 shown in FIG. 1, the heating portion 20 can be attached and fixed to the ends of the thread-groove-exhaust-portion stators 18A and 18B by fastening bolts BT1 as in the attachment structure example shown in FIG. 4.

In particular, in the attachment structure example shown in FIG. 4, bolt through-holes are respectively provided in the heater spacer 22 and the heating plate 23. The heater spacer 22 and the heating plate 23 are integrally attached and fixed to the ends of the thread-groove-exhaust-portion stators 18A and 18B by the fastening bolts BT1 inserted through the bolt through-holes to configure a heating unit including the heating portion 20 and the thread-groove-exhaust-portion stators 18A and 18B.

In the attachment structure example shown in FIG. 4, a common bolt through-hole is provided in the heater spacer 22 and the base spacer 1B. The heating portion 20 is retrofitted and fixed to the base spacer 1B by a fastening bolt BT2 inserted through the common bolt through-hole.

After the heating portion 20 is assembled to the base spacer 1B as shown in FIG. 4, in work for inspecting heating states of the thread-groove-exhaust-portion stators 18A and 18B, in particular, it is difficult to measure, with a temperature measuring device, a surface temperature near the lower ends of the thread-groove-exhaust-portion stators 18A and 18B. However, in the state of the heating unit including the heating portion 20 and the thread-groove-exhaust-portion stators 18A and 18B explained above, the base spacer 1B is absent around the thread-groove-exhaust-portion stators 18A and 18B. Therefore, workability in inspecting the heating state of the thread-groove-exhaust-portion stators 18A and 18B is excellent, for example, it is possible to easily measure, with the temperature measuring device, the surface temperature near the lower ends of the thread-groove-exhaust-portion stators 18A and 18B.

In the attachment structure example shown in FIG. 4, as the unit for heating the thread-groove-exhaust-portion stators 18A and 18B more preferentially than the heater spacer 22, a lightening portion N like a circumferential groove including the bolt through-holes of the fastening bolts BT1 is provided near the boundary between the heater spacer 22 and the heating plate 23 to reduce a contact area of the heating plate 23 and the heater spacer 22 and reduce heat conduction from the heating plate 23 to the heater spacer 22.

In the heating portion 20, as a method of fixing the recess 21 and the yoke 25, it is possible to adopt a method of pressing the yoke 25 into the recess 21, a method of fixing the recess 21 and the yoke 25 with a not-shown thread, or a method of bonding the yoke 25 in the recess 21.

In the heating portion 20, as a method of fixing the yoke 25 and the coil 26, it is possible to adopt a method of filling resin or the like in the yoke 25 to mold the entire coil 26 with the resin or the like.

Further, in the heating portion 20, as a method of fixing the heating plate 23 and the thread-groove-exhaust-portion stators 18A and 18B, it is possible to adopt a method of providing a projection on the surface of the heating plate 23, for example, as shown in FIG. 4 and press the projection into between the thread-groove-exhaust-portion stator 18B on the outer side and the thread-groove-exhaust-portion stator 18A on the inner side or a method of fitting the projection between the thread-groove-exhaust-portion stator 18B on the outer side and the thread-groove-exhaust-portion stator 18A on the inner side and bonding the thread-groove-exhaust-portion stator 18B on the outer side and the thread-groove-exhaust-portion stator 18A on the inner side.

Note that, in the heating portion 20, the heating plate 23 and the thread-groove-exhaust-portion stators 18A and 18B are fastened by the fastening bolts BT1 as explained above. Therefore, the fixing methods by the press-in and the bonding of the heating plate 23 and the thread-groove-exhaust-portion stators 18A and 18B explained above can be omitted according to necessity.

FIG. 5 is an explanatory diagram of a structure example in which a cooling unit is provided in the heating portion.

When cooling unit is attached in the vacuum pump P1 shown in FIG. 1, for example, as in the structure example shown in FIG. 5, when the heater spacer 22 of the heating portion 20 is manufactured by casting, a water cool pipe 7 can be embedded in the heater spacer 22 as the cooling unit.

The heater spacer 22 and the base spacer 1B are separate components. The heater spacer 22 has a form like a relatively thin doughnut shape plate as a whole. Therefore, manufacturing work of the heater spacer 22 by the casting and work itself for casting the water cool pipe 7 in the heater spacer 22 in the casting are relatively easy.

FIG. 6 is an explanatory diagram of a structure example in which adhesion of a product in an outlet port is prevented by heating.

In the structure example shown in FIG. 6, a heat conduction pipe 8 is mounted on the outer circumference of an exhaust pipe 30 configuring the outlet port 3 and a flange section at the end of the heat conduction pipe 8 is attached to the outer circumferential section of the heater spacer 22 of the heating portion 20 by a fastening bolt BT3. In this structure example, the exhaust pipe 30 is heated by the heat of the heater spacer 22 via the heat conduction pipe 8 to prevent adhesion of a product in the outlet port 3.

As a method of mounting the heat conduction pipe 8 on the exhaust pipe 30, for example, it is possible to adopt a method of attaching the heat conduction pipe 8 by vertically dividing the heat conduction pipe 8 into a plurality of pieces (e.g., into two) in the axial direction thereof or a method of attaching the heat conduction pipe 8 in size equal to or smaller than the diameter of the exhaust pipe 30.

FIG. 7 is an explanatory diagram of a structure example in which the heater spacer and the base spacer of the heating portion are integrated.

The heater spacer 22 of the heating portion 20 explained above can be integrated with the base spacer 1B as in the structure example shown in FIG. 7. Consequently, it is possible to reduce the number of components. Assembly work of the heater spacer 22 to the base spacer 1B becomes unnecessary. It is possible to attain improvement of pump assembly accuracy.

FIG. 8 is an explanatory diagram of a structure example in which the heater spacer, the base spacer, and the stator base of the heating portion are integrated.

The heater spacer 22, the base spacer 1B, and the stator base 4 of the heating portion 20 explained above can also be integrated as shown in FIG. 8. Consequently, it is possible to attain a further reduction in the number of components and improvement of the pump assembly accuracy.

The attachment structure example shown in FIG. 8 adopts a configuration in which bolt through-holes are respectively provided in the thread-groove-exhaust-portion stator 18A on the inner side and the heating plate 23 and the thread-groove-exhaust-portion stator 18A on the inner side and the heating plate 23 are integrated and attached and fixed to the stator base 4 by a fastening bolt BT4 inserted through the bolt through-holes and a configuration in which a bolt through-hole is provided in the thread groove exhausts section stator 18B on the outer side and the thread-groove-exhaust-portion stator 18B on the outer side is attached and fixed to the base spacer 1B by the fastening bolt BT4 inserted through the bolt through-hole such that an end face on the lower side of the thread-groove-exhaust-portion stator 18B on the outer side is in contact with the heating plate 23.

FIG. 9 is an explanatory diagram of another attachment example of the temperature sensor.

As in the attachment example shown in FIG. 9, the temperature sensor 51 may be attached to be embedded in the thread-groove-exhaust-portion stators 18A and 18B. In the attachment example shown in FIG. 9, the sensor attachment hole 50 having length reaching the thread-groove-exhaust-portion stators 18A and 18B from the recess 21 through the heating plate 23 is formed. The temperature sensor 51 is inserted into the sensor attachment hole 50 and fixed by an adhesive or the like. In this case as well, the wire of the temperature sensor 51 is connected to the connector 100 from the sensor attachment hole 50 through the recess 21 and the wire through-hole 102. A seal means 52 (e.g., an O-ring) is disposed between the lower end of the thread-groove-exhaust-portion stators 18A and 18B and the upper end of the heating plate 23.

FIG. 10 is a cross-sectional view of a vacuum pump (a thread groove pump return flow type) according to a second embodiment of the present invention.

The vacuum pump P1 shown in FIG. 1 is the configuration (the thread groove pump parallel flow type) in which gas flows in parallel on the inner circumference side and the outer circumference side of substantially the lower half (the second cylinder body 62) of the rotor 6. A vacuum pump P2 shown in FIG. 10 is different in the type.

The vacuum pump P2 shown in FIG. 10 is a configuration (the thread groove pump return flow type) in which, as indicated by an arrow U in the figure, a flow of gas returns in the vertical direction on the lower end side and the upper end side of the second cylinder body 62 configuring the rotor 6, whereby the gas flows in opposite directions on the inner circumference side and the outer circumference side of substantially the lower half (the second cylinder body 62) of the rotor 6. Note that the basic configuration of the vacuum pump P2 other than the configuration is the same as the configuration of the vacuum pump P1 shown in FIG. 1. Therefore, in FIG. 10, members same as the members shown in FIG. 1 are denoted by the same reference numerals. Detailed explanation of the members is omitted.

The heating portion 20 adopted in the vacuum pump P1 shown in FIG. 1 explained above can also be applied to the vacuum pump P2 of the thread groove pump return flow type shown in FIG. 10. Note that the specific configuration of the heating portion 20 applied to the vacuum pump P2 shown in FIG. 10 is the same as the configuration of the heating portion 20 adopted in the vacuum pump P1 shown in FIG. 1. Therefore, detailed explanation of the configuration is omitted.

As the gas outlet port 3 shown in FIG. 10, the outlet port shown in FIG. 1 may be configured in the stator base 4.

FIG. 11 is a cross-sectional view of a vacuum pump (a thread groove pump single flow type) according to a third embodiment of the present invention.

A vacuum pump P3 shown in FIG. 11 is configured such that the thread groove exhaust cannel R2 is formed only on the outer circumference side of the rotor 6 by omitting the thread-groove-exhaust-portion stator 18A on the inner side in the vacuum pump P1 shown in FIG. 1.

The heating portion 20 adopted in the vacuum pump P1 shown in FIG. 1 can also be applied to the vacuum pump P3 shown in FIG. 11. In particular, in an application example shown in FIG. 11, as a specific configuration of the heating portion 20, a protrusion 28 projecting toward the second cylinder body 62 is provided in the heating plate 23.

The protrusion 28 is disposed to be opposed to the inner circumference of the second cylinder body 62 to form a clearance seal and reduces intrusion of gas, which reaches the annular confluence channel S1 from a downstream outlet of the thread groove exhaust channel R2, into an inner side space of the rotor 6.

Note that, in the heating portion 20 shown in FIG. 11, the specific configuration other than the protrusion 28 is the same as the configuration of the heating portion 20 adopted in the vacuum pump P1 shown in FIG. 1. Therefore, detailed explanation of the configuration is omitted.

FIG. 12 is an explanatory diagram of a structure example in which the yoke of the heating portion is omitted.

The heater spacer 22 of the heating portion 20 can also be formed of a magnetic material. In this case, as in the structure example shown in FIG. 12, the yoke 25 (see FIG. 1) can be omitted. Consequently, it is possible to attain a reduction in the number of components.

In the structure example shown in FIG. 12, as explained above, since the heater spacer 22 is the magnetic material, when a high-frequency alternating current flows to the coil 26, not only the coil 26 and the heating plate 23 but also the coil 26 and the heater spacer 22 are electromagnetically coupled. An eddy current is also generated on the inside of the heater spacer 22 besides the heating plate 23. Consequently, sufficient Joule heat is also generated in the heater spacer 22. The base spacer 1B and the stator base 4 can be heated by heat conduction from the heater spacer 22.

FIG. 13 is an explanatory diagram of a structure example in which a magnetic flux leak of the coil can be more effectively reduced.

In the heating portion 20, as explained above, the wire through-hole 102 is also formed in the yoke 25 in order to insert the wire 103 of the coil 26 and the wire of the temperature sensor 51 therethrough. Therefore, it is likely that magnetic flux of the coil 26 leaks to the outside through the wire through-hole 102.

On the other hand, in the structure example shown in FIG. 13, as a means for reducing a magnetic flux leak, a shield pipe 200 formed of a magnetic material is mounted on the entire range of the wire through-hole 102 from the yoke 25 to the connector mounting portion 101 and a part of the connector mounting portion 101. A shield plate 201 formed of a magnetic material is disposed around the connector 100. Therefore, it is possible to effectively reduce the magnetic flux leak.

Note that, in the vacuum pump P1 shown in FIG. 1 as well, a reduction in a magnetic flux leak is attained by applying the structure example shown in FIG. 13. The structure example shown in FIG. 13 can be applied to not only a configuration in which the inside of the recess 21 of the heating portion 20 is the outside pressure as in the vacuum pump P1 shown in FIG. 1 but also a configuration in which the inside of the recess 21 is a vacuum.

Incidentally, in the structure example shown in FIG. 13, both of the shield pipe 200 and the shield plate 201 are used. However, if a magnetic flux leak can be sufficiently reduced by only one of the shield pipe 200 and the shield plate 201, the other can be omitted.

FIG. 14 is an explanatory diagram of another example of the structure of the heating portion. FIG. 15 is a partially enlarged view of the heating portion shown in FIG. 14.

A heating portion 70 shown in FIG. 14 is applied to the vacuum pump (the thread groove parallel flow pipe) according to the first embodiment of the present invention shown in FIG. 1. Detailed explanation of components denoted by reference numerals same as the reference numerals in FIG. 1 is omitted.

The heating portion 70 shown in FIG. 14 includes, as shown in FIG. 15, a heater spacer 71 including a recess 72, a yoke 73 disposed in the recess 72, a heating plate 74 in contact with the lower end face of the thread-groove-exhaust-portion stators 18A and 18B shown in FIG. 14 and including a groove 75 attached to the heater spacer 71 to cover the recess 72, a coil 77 disposed in the groove 75, and an elastic O-ring 83 functioning as a seal means capable of setting the inside of the recess 72 and the groove 75 to the outside pressure.

The heating portion 70 is configured to heat the yoke 73 and the heating plate 74 with electromagnetic induction heating by feeding a high-frequency alternating current to the coil 77 to thereby heat the heater spacer 71, the thread-groove-exhaust-portion stators 18A and 18B, the base spacer 1B, and the stator base 4.

The O-ring 83 seals opening peripheral edges of the recess 72 and the groove 75 shown in FIG. 15 to thereby cut off the recess 72 and the groove 75 from a vacuum region such as the inner and outer thread groove exhaust channels R1 and R2 shown in FIG. 1 and make it possible to set the insides of the recess 72 and the groove 75 to the outside pressure.

In the case of a configuration including the O-ring 83, as shown in FIG. 15, the heating portion 70 includes an O-ring groove 84 for attaching the O-ring 83 to the heating plate 74 and a minimum diameter portion 85 provided between an opening end face to a bottom surface of the O-ring groove 84. The minimum diameter portion 85 may be formed larger than an inner diameter of the O-ring 83 or configured by a protrusion portion 86 provided at an edge of the O-ring groove 84 to thereby function as an O-ring drop preventing means for preventing a drop of the O-ring 83.

Further, the O-ring groove 84 and the O-ring 83 shown in FIG. 15 may be set in the heater spacer 71. In this case, the O-ring-drop preventing means may be deleted.

In FIG. 15, the heating plate 74 and the coil 77 are electrically insulated by an insulating plate 81 interposed between the heating plate 74 and the coil 77. The heater spacer 71 is formed of an aluminum alloy. The heating plate 74 and the yoke 73 are formed of an iron-base material (e.g., pure iron, S15C, or S25C) or a stainless steel material having magnetism (e.g., a ferrite-base stainless steel material, SUS430, SUS304, or SUS420J2). The coil 77 is formed of a good conductor (e.g., a copper material).

When a high-frequency alternating current is fed to the coil 77, the coil 77, the heating plate 74, and the yoke 73 are electromagnetically coupled. An eddy current is generated on the insides of the heating plate 74 and the yoke 73. Then, since the heating plate 74 and the yoke 73 have peculiar electric resistances, Joule heat is generated in the heating plate 74 and the yoke 73. Iron loss heat generation occurs in the heating plate 74 and the yoke 73 and copper loss heat generation occurs in the coil 77. The thread-groove-exhaust-portion stators 18A and 18B and the heater spacer 71 are preferentially heated by these kinds of heat. Further, the base spacer 1B and the stator base 4 are also heated by heat conduction from the heater spacer 71.

The distance from the coil 77 to the yoke 73 and the distance from the coil 77 to the heating plate 74 equivalent to the thickness of the insulating plate 81 can be changed as appropriate according to necessity. However, from the viewpoint of preventing adhesion of a product on the thread-groove-exhaust-portion stator side, the distances are preferably set to distances with which the heating plate 74 can be more effectively heated than the yoke 73.

In the heating portion 70, the cross-sectional shape of the yoke 73 is formed in a plate shape. The upper end of the yoke 73 is disposed close to the heating plate 74. Consequently, the coil 77 in the heating plate 74 is disposed in a space surrounded by the heating plate 74 and the yoke 73 formed of the magnetic material. Therefore, a magnetic flux leak of the coil 77 decreases and improvement of heating efficiency is attained.

The heating portion 70 includes a temperature sensor 79 attached to a sensor attachment hole 78 and a temperature control means (not shown in the figure) that controls, on the basis of a detection value in the temperature sensor 79, the heating plate 74 to have a predetermined temperature.

Further, the heating portion 70 may include a temperature sensor 80 attached to the coil 77 and a temperature control means (not shown in the figure) that controls, on the basis of a detection value in the temperature sensor 80, the coil 77 not to have temperature exceeding a predetermined temperature.

For the attachment of the temperature sensor 79 to the heating plate 74, as shown in FIG. 15, the sensor attachment hole 78 opened to only the groove 75 side is formed in the heating plate 74 and the temperature sensor 79 is inserted into the sensor attachment hole 78. For the attachment of the temperature sensor 80 to the coil 77, as shown in FIG. 15, the temperature sensor 80 is stuck to the surface of the coil 77. A wire of the temperature sensor 79 of the two temperature sensors 79 and 80 is connected from the sensor attachment hole 78 to the connector 100 through the groove 75, the recess 72, and the wire through-hole 102, while a wire of the temperature sensor 80 is connected from the groove 75 to the connector 100 through the recess 72 and the wire through-hole 102.

In the heating portion 70 shown in FIG. 15, resin 82 is filled in the groove 75 and the sensor attachment hole 78 to mold the coil 77, the insulating plate 81, and the temperature sensors 79 and 80. As a means for preventing a drop of the coil 77, the heating portion 70 may include a drop preventing unit configured by a protrusion portion 76 provided as the edge of the groove 75.

The heating portion 70 shown in FIG. 15 adopts a configuration in which the yoke 73 is fixed by a fastening bolt BT5 in the recess 72 of the heater spacer 71. As a configuration different from this configuration, although not shown in the figure, the heating portion 70 may adopt a configuration in which the heating portion 70 includes the heater spacer 71 from which the recess 72 is deleted and the yoke 73 and the groove 75 is formed in the heating plate 74 to enclose the yoke 73 and a configuration in which the yoke 73 is fixed on the heater spacer 71 by the fastening bolt BT5. With the heating portion 70 having such a configuration, it is possible to omit the recess 72. Consequently, it is possible to attain a reduction of machining sections. Note that the heating portion 70 having such a configuration is the same as the heating portion 70 having the configuration shown in FIGS. 14 and 15. Therefore, detailed explanation of the heating portion 70 is omitted.

As explained above, in the vacuum pumps P1, P2, and P3 in the first to third embodiments, as the specific configuration of the heating portion 20 (70), the heating portion 20 (70) adopts a configuration in which the yoke 25 (73) and the heating plate 23 (74) are heated by the electromagnetic induction heating by feeding the alternating current to the coil 26 (77) to heat the heater spacer 22 (71), the thread-groove-exhaust-portion stators 18A and 18B, the base spacer 1B, and the stator base 4. Therefore, adhesion of a product in the base spacer 1B and the stator base 4 can also be prevented by the heating of the base spacer 1B and the stator base 4 by the heating portion 20 (70). Consequently, it is possible to reduce an adhesion amount of the product in the vacuum pump as a whole.

With the vacuum pumps P1, P2, and P3 in the first to third embodiments, as a specific configuration of the heating portion 20 (70), the heating portion 20 (70) adopts a configuration in which the coil 26 (77) is disposed in the recess 21 of the heater spacer 22 (the groove 75 of the heating plate 74) that can be set to the outside pressure by the seal means 24 (83) and a configuration in which the inside of the recess 21 (the groove 75) is set to the outside pressure that does not cause vacuum electric discharge such as the atmospheric pressure or pressure close to the atmospheric pressure. Therefore, it is possible to prevent insulating coating breakage of the coil 26 (77) due to the vacuum electric discharge and attain extension of the life of the coil 26 (77). It is possible to prevent a failure of the electric system of the vacuum pump such as a short circuit due to insulating coating breakage of the coil 26 (77). It is possible to stably continuously operate the vacuum pump for a long period.

Further, in the vacuum pumps P1, P2, and P3 in the first to third embodiments, the inside of the recess 21 (the groove 75) is set to, for example, the atmospheric pressure or pressure close to the atmospheric pressure. Therefore, when the wire 103 of the coil 26 (77) in the recess 21 (the groove 75) is connected to the connector 100, it is unnecessary to use an expensive vacuum connector as the connector 100. An inexpensive connector can be used. Therefore, it is possible to attain a reduction in costs of the vacuum pump as a whole.

FIG. 16 is a cross-sectional view of a vacuum pump (a thread groove pump parallel flow type) according to a fourth embodiment of the present invention. FIG. 17A is an enlarged view of an A part of FIG. 16. FIG. 17B is an enlarged view of a heating plate.

In a vacuum pump P4 shown in FIG. 16, members same as the members of the vacuum pump P1 shown in FIG. 1 are denoted by the same reference numerals and detailed explanation of the members is omitted.

<<Explanation of a Heating Portion in the Vacuum Pump Shown in FIG. 16>>

In the vacuum pump P4 shown in FIG. 16, as in the vacuum pump P1 shown in FIG. 1, the heating portion 20 is provided below the thread-groove-exhaust-portion stators 18A and 18B as a means for preventing adhesion of a product. Specifically, like the heating portion 20 shown in FIG. 1, the heating portion 20 shown in FIG. 16 is provided between the thread-groove-exhaust-portion stators 18A and 18B and the stator base 4 disposed in the lower parts of the thread-groove-exhaust-portion stators 18A and 18B.

The heating portion 20 shown in FIG. 16 includes, as shown in FIGS. 17A and 17B, the heating plate 23 in contact with one of the thread-groove-exhaust-portion stator 18A on the inner side (hereinafter referred to as "inner thread-groove-exhaust-portion stator 18A" according to necessity) and the thread-groove-exhaust-portion stator 18B on the outer side (hereinafter referred to as "outer thread-groove-exhaust-portion stator 18B" according to necessity), the yoke 25 disposed in a pump base 1D, and the coil 26 disposed on the yoke 25. Note that, as the pump base 1D, the base spacer 1B and the stator base 4 shown in FIG. 1 are integrated.

The heating portion 20 shown in FIGS. 17A and 17B is configured to heat the heating plate 23 and the yoke 25 with electromagnetic induction heating by feeding a high-frequency alternating current to the coil 26 to thereby heat the inner thread-groove-exhaust-portion stator 18A, the outer thread-groove-exhaust-portion stator 18B, and the pump base 1D. Further, the heating portion 20 can also heat the stator column 4 with heat conduction from the pump base 1D.

In the heating portion 20 shown in FIGS. 17A and 17B, the recess 21 is provided on the pump base 1D side, the heating plate 23 is disposed near the opening of the recess 21, and the yoke 25 is disposed in the recess 21. The recess 21 is formed in an annular shape to turn around a lower part outer circumference of the stator column 4 and formed to open from the pump base 1D side toward the ends of the thread-groove-exhaust-portion stators 18A and 18B. However, the recess 21 can be omitted.

The heating plate 23 in the heating portion 20 shown in FIGS. 17A and 17B is separated into a plurality of heating plates as two or more separated heating plates 23A and 23B located between the opening of the recess 21 and the ends of the thread-groove-exhaust-portion stators 18A and 18B and in contact with one of the inner thread-groove-exhaust-portion stator 18A and the outer thread-groove-exhaust-portion stator 18B.

As a specific structure example of the plurality of separated heating plates 23, in the vacuum pump P4 shown in FIG. 16, an inner/outer double ring-like member turning around the lower part outer circumference of the stator column 4 are prepared according to the cylindrical shape of the inner thread-groove-exhaust-portion stator 18A and the outer thread-groove-exhaust-portion stator 18B and the annular shape of the recess 21. The inner/outer double ring-like member is adopted as the separated heating plate 23A on the inner side and the separated heating plate 23B on the outer side.

In the vacuum pump P4 shown in FIG. 16, the separated heating plate 23A on the inner side is attached in direct contact with the end of the inner thread-groove-exhaust-portion stator 18A to be provided to function as a means for concentratedly heating the inner thread-groove-exhaust-portion stator 18A. On the other hand, the separated heating plate 23B on the outer side is attached in direct contact with the end of the outer thread-groove-exhaust-portion stator 18B to be provided to function as a means for concentratedly heating the outer thread-groove-exhaust-portion stator 18B.

In the heating portion 20 shown in FIGS. 17A and 17B as well, the yoke 25 and the coil 26 are electrically insulated by the insulating plate 27 interposed between the yoke 25 and the coil 26. The heating plate 23 and the yoke 25 in the heating portion 20 shown in FIGS. 17A and 17B are also formed of a magnetic material such as an iron-base material (e.g., pure iron, S15C, or S25C) or a stainless steel material having magnetism (e.g., a ferrite-base stainless steel material, SUS430, SUS304, or SUS420J2). The coil 26 is formed of a good conductor (e.g., a copper material).

Referring to FIGS. 17A and 17B, in the pump base 1D, the connector mounting portion 101 for mounting the connector 100, the wire through-hole 102 connecting with the recess 21 from the connector mounting portion 101, and the wire 103 of the coil 26 inserted through the wire through-hole 102 to connect the coil 26 and the connector 100 are provided. In the yoke 25 as well, the wire through-hole 102 is provided in order to insert the wire 103 of the coil 26 and the wire of the sensor 51 therethrough. The connector 100, the connector mounting portion 101, the wire through-hole 102, the wire 103, and the wire of the sensor 51 shown in FIGS. 17A and 17B are disposed in horizontal positions (a direction facing the outer circumference of the base 1B) but may be disposed in vertical positions (in a direction facing the bottom surface of the base 1B).

In FIGS. 17A and 17B, when a high-frequency alternating current is fed from the connector 100 to the coil 26 via the wire 103, the coil 26, the heating plate 23 (the separated heating plats 23A and 23B), and the yoke 25 are electromagnetically coupled. An eddy current is generated on the insides of the heating plate 23 and the yoke 25. Then, since the heating plate 23 and the yoke 25 have peculiar electric resistances, Joule heat is generated in the heating plate 23 and the yoke 25. Iron loss heat generation occurs in the heating plate 23 and the yoke 25 and copper loss heat generation occurs in the coil 26. The thread-groove-exhaust-portion stators 18A and 18B are preferentially heated by, in particular, the heat generated in the heating plate 23 among these kinds of heat. The base spacer 1B is preferentially heated by heat generated in the yoke 25. Moreover, the stator column 4 is also heated by heat conduction from the pump base 1D.

The inner and outer separated heating plates 23A and 23B may be formed of magnetic materials having the same material properties to thereby set a heat value of each of the separated heating plates 23A and 23B to be substantially the same. However, as another embodiment, the separated heating plates 23A and 23B may be formed of magnetic materials having different material properties to thereby vary the heat value for each of the separated heating plates 23A and 23B.

The inner thread-groove-exhaust-portion stator 18A and the outer thread-groove-exhaust-portion stator 18B sometimes have different heat values because of, for example, differences in mass, a material, and a heat loss thereof. For example, the heat value of the outer thread-groove-exhaust-portion stator 18B is sometimes larger than the heat value of the inner thread-groove-exhaust-portion stator 18A. In this case, for example, the heat value of the separated heating plate 23B on the outer side can be set larger than the heat value of the separated heating plate 23A on the inner side by forming the separated heating plate 23B on the outer side from a pure iron-base material and, on the other hand, forming the separated heating plate 23A on the inner side from a stainless steel material. Consequently, it is possible to heat by the heating plate 25 the thread-groove-exhaust-portion stators 18A and 18B according to the heat values of the thread-groove-exhaust-portion stators 18A and 18B, for example, heat the inner thread-groove-exhaust-portion stator 18A and the outer thread-groove-exhaust-portion stator 18B to substantially the same temperatures or heat the inner thread-groove-exhaust-portion stator 18A and the outer thread-groove-exhaust-portion stator 18B to respective target temperatures.

Besides, as a method of changing material properties, there is a method of adding an additive to a material. For example, ceramics are added to the material of the separated heating plates to partially change physical properties such as electric resistance of the material. Consequently, it is possible to change a heat value concerning not only the entire separated heating plates but also a part of the separated heating plates.

FIGS. 18 to 22 are explanatory diagrams of other embodiments concerning the separation of the heating plate 23 explained above.

Like the heating plate 23 shown in FIGS. 16 to 17B explained above, the heating plate 23 shown in FIGS. 18 to 23 is separated as the inner and outer separated heating plates 23A and 23B. Specific separation configurations are as explained below.

In the heating plate 23 shown in FIGS. 16 to 17B, the inner and outer separated heating plates 23A and 23B configuring the heating plate 23 are formed in a symmetrical cross-sectional shape with respect to a gap portion G3 (hereinafter referred to as "separation gap G3") formed by the separation. On the other hand, in the heating plate 23 shown in FIGS. 18 and 19, the inner and outer separated heating plates 23A and 23B configuring the heating plate 23 have an asymmetrical cross-sectional shape with respect to the separation gap G3. Therefore, a heating range and a heat value are different for each of the separated heating plates 23A and 23B.

In particular, in the heating plate 23 shown in FIG. 18, widths L1 and L2 of the inner and outer separated heating plates 23A and 23B are different, the inner and outer separated heating plates 23A and 23B are formed in an asymmetrical cross-sectional shape with respect to the separation gap G3. For example, when the heat value of the outer thread-groove-exhaust-portion stator 18B is larger than the heat value of the inner thread groove exhausts section stator 18A, the temperature of the outer thread-groove-exhaust-portion stator 18B less easily rises. In this case, as shown in FIG. 18, the width L1 of the separated heating plate 23A on the outer side is set larger than the width L2 of the separated heating plate 23A on the inner side. Consequently, the heating plate 23 can heat the thread-groove-exhaust-portion stators 18A and 18B according to the heat values of the thread-groove-exhaust-portion stators 18A and 18B, for example, heat the inner thread-groove-exhaust-portion stator 18A and the outer thread-groove-exhaust-portion stator 18B to substantially the same temperatures or heat the inner thread-groove-exhaust-portion stator 18A and the outer thread-groove-exhaust-portion stator 18B to respective target temperatures.

On the other hand, in the heating plate 23 shown in FIG. 19, thicknesses H1 and H2 of the inner and outer separated heating plates 23A and 23B are different. Therefore, the inner and outer separated heating plates 23A and 23B are formed in an asymmetrical cross-sectional shape with respect to the separation gap G3. For example, when the heat value of the outer thread-groove-exhaust-portion stator 18B is larger than the heat value of the inner thread-groove-exhaust-portion stator 18A, as shown in FIG. 19, the thickness H1 of the separated heating plate 23B on the outer side is set larger than the thickness H2 of the separated heating plate 23A on the inner side. Consequently, the heating plate 23 can heat the thread-groove-exhaust-portion stators 18A and 18B according to the heat values of the thread-groove-exhaust-portion stators 18A and 18B, for example, heat the inner thread-groove-exhaust-portion stator 18A and the outer thread-groove-exhaust-portion stator 18B to substantially the same temperatures or heat the inner thread-groove-exhaust-portion stator 18A and the outer thread-groove-exhaust-portion stator 18B to respective target temperatures.

In the heating plate 23 shown in FIG. 20, as the inner and outer separated heating plates 23A and 23B configuring the heating plate 23, the separated heating plate 23A on the inner side is formed of a solid material and the separated heating plate 23B on the outer side is formed of a laminated material. Consequently, the heat value of the separated heating plate 23B on the outer side is set to be smaller than the heat value of the separated heating plate 23A on the inner side. This setting is an example in the case in which the heat value of the outer thread-groove-exhaust-portion stator 18B is smaller than the heat value of the inner thread-groove-exhaust-portion stator 18A. In the opposite case of this example, the separated heating plate 23A on the inner side only has to be formed of the laminated material and the separated heating plate 23B on the outer side only has to be formed of the solid material.

As still another embodiment in which the laminated material explained above is adopted, it is also possible to set the heating value to be different for each of the separated heating plates 23A and 23B by forming both of the inner and outer separated heating plates 23A and 23B from the laminated material and changing the number of laminated materials in the inner and outer separated heating plates 23A and 23B.

In the heating plate 23 shown in FIGS. 21 and 22, the inner and outer separated heating plates 23A and 23B configuring the heating plate 23 are formed in an asymmetrical cross-sectional shape with respect to the separation gap G3 because separated portions thereof overlap in the vertical direction. In addition, the separation gap G3 (the separated portion of the heating plate 23) is formed in a passage shape bent in zigzag.

Since the separation gap G3 is an air gap, a magnetic flux leak of the coil 26 from the separation gap G3 to the upper side of the heating plate 23 is inevitable. However, with the superimposed structure of the separated heating plates 23A and 23B shown in FIGS. 21 and 22, the length of the separation gap G3 increases because the separation gap G3 is formed in the passage shape bent in zigzag as explained above. Therefore, it is possible to effectively reduce the magnetic flux leak of the coil 26 from the separation gap G3 to the upper side of the heating plate 23.

In particular, in the superimposed structure of the separated heating plates 23A and 23B shown in FIG. 21, the widths L1 and L2 of the inner and outer separated heating plates 23A and 23B are also different. Therefore, a heat generation range and a heat value are different for each of the separated heating plates 23A and 23B. It is also possible to heat the thread-groove-exhaust-portion stators 18A and 18B according to the heat values of the thread-groove-exhaust-portion stators 18A and 18B.

In the vacuum pump P4 shown in FIG. 16, as a means for enabling the heating portion 20 to heat the inner thread-groove-exhaust-portion stator 18A and the outer thread-groove-exhaust-portion stator 18B more preferentially than the pump base 1D, an air gap G2 is provided between the inner thread-groove-exhaust-portion stator 18A and the stator column 4 and the gap G2 is provided between the outer thread-groove-exhaust-portion stator 18B and the pump base 1D to set both of a contact area of the inner thread-groove-exhaust-portion stator 18A and the stator column 4 and a contact area of the outer thread-groove-exhaust-portion stator 18B and the pump base 1D to be small.

In FIGS. 16 to 17B, the distance from the coil 26 to the heating plate 23 and the distance from the coil 26 to the yoke 25 equivalent to the thickness of the insulating plate 27 can be changed as appropriate according to necessity. However, from the viewpoint of effectively preventing adhesion of a product on the thread-groove-exhaust-portion stators 18A and 18B side, the distances are preferably set to distances with which the heating plate 23 can be more effectively heated than the yoke 25.

In the heating portion 20 shown in FIGS. 16 to 17B, the cross-sectional shape of the yoke 25 is formed in an upward groove shape toward the inner and outer thread-groove-exhaust-portion stators 18A and 18B. The upper end of the yoke 25 is disposed close to the heating plate 23.

Consequently, the coil 26 in the yoke 25 is disposed in a space surrounded by the heating plate 23 and the yoke 25 formed of the magnetic material. Therefore, a magnetic flux leak of the coil 26 is little.

In the heating portion 20 shown in FIGS. 16 to 17B, a predetermined gap portion is provided between the yoke 25 and the heating plate 23. Consequently, heat generated in the heating plate 23 less easily escapes to the pump base 1D side through the yoke 25. It is possible to preferentially heat the thread-groove-exhaust-portion stators 18A and 18B with the heating plate 23.

The vacuum pump P4 shown in FIG. 16 further includes, as shown in FIGS. 17A and 17B, the temperature sensor 51 that detects the temperature in the pump and a temperature control means (not shown in the figure) that controls, on the basis of a detection value in the temperature sensor 51, the heating plate 23 to have a predetermined temperature. Note that, in the vacuum pump P4 shown in FIG. 16, as shown in FIGS. 17A and 17B, the temperature sensor 51 is attached to the outer thread-groove-exhaust-portion stator 18B. However, the temperature sensor 51 is not limited to the attachment position. For example, the temperature sensor 51 may be attached to the inner thread-groove-exhaust-portion stator 18A or the heating plate 23.

The heating portion 20 shown in FIGS. 16 to 17B may include a coil temperature sensor (not shown in the figure) attached to the coil 26 and a temperature control means (not shown in the figure) that controls, on the basis of a detection value in the temperature sensor, the coil not to have temperature exceeding a predetermined temperature.

In the vacuum pump P4 shown in FIG. 16, a through-hole is formed in the heating plate 23. Wires of the temperature sensor 51 and the coil temperature sensor are connected to the connector 100 through the through-hole, the recess 21, and the wire through-hole 102. However, another connection method may be adopted.

The heating portion 20 shown in FIGS. 16 to 17B can adopt, as a method of fixing the recess 21 and the yoke 25, for example, a method of pressing the yoke 25 into the recess 21, a method of fixing the recess 21 and the yoke 25 with a not-shown thread, or a method of fixing the yoke 25 in the recess 21 with an adhesive.

The heating portion 20 shown in FIGS. 16 to 17B can adopt, as a method of fixing the yoke 25 and the coil 26, a method of filling resin or the like in the yoke 25 to mold the entire coil 26 with the resin or the like.

Further, the heating portion 20 shown in FIGS. 16 to 17B can adopt, as a method of fixing the heating plate 23 and the inner and outer thread-groove-exhaust-portion stators 18A and 18B, for example, a method of fitting a projection provided on the surface of the heating plate 23 (the separated heating plates 23A and 23B) into between the outer thread-groove-exhaust-portion stator 18B and the inner thread-groove-exhaust-portion stator 18A and fixing the heating plate 23 and the thread-groove-exhaust-portion stators 18A and 18B with fastening bolts (a bolt fixing method) or a method of fixing the heating plate 23 and the thread-groove-exhaust-portion stators 18A and 18B with an adhesive (a bonding fixing method). The bolt fixing method and the bonding fixing method may be used together.

In the heating portion 20 shown in FIGS. 16 to 17B, the wire through-hole 102 is also formed in the yoke 25 in order to insert the wire 103 of the coil 26 and the wires of the temperature sensor 51 and the coil temperature sensor therethrough. Therefore, it is likely that magnetic flux of the coil 26 leaks to the outside through the wire through-hole 102. Therefore, in the heating portion 20 shown in FIGS. 16 to 17B, as a means for reducing a magnetic flux leak, the shield pipe 200 formed of a magnetic material is mounted on the entire range of the wire through-hole 102 from the yoke 25 to the connector mounting portion 101 and the shield plate 201 formed of a magnetic material is disposed around the connector 100. Note that, if a magnetic flux leak can be sufficiently prevented by only one of the shield pipe 200 and the shield plate 201, the other can be omitted.

The vacuum pump P4 shown in FIG. 16 has a structure in which the heating portion 20, the pump base 1D, and a stator column 4 are integrated. However, the heating portion 20, the pump base 1D, and the stator column 4 can be formed as separate components.

As explained above, in the vacuum pump P4 in the fourth embodiment, as a specific configuration of the heating portion 20, the heating portion 20 has a function of heating the heating plate 23 and the yoke 25 with electromagnetic induction heating by feeding an alternating current to the coil 26 to thereby heat the inner thread-groove-exhaust-portion stator 18A, the outer thread-groove-exhaust-portion stator 18B, and the pump base 1D. Therefore, it is possible to prevent adhesion of a product in the pump base 1D by heating the pump base 1D with the heating portion 20. In addition, it is also possible to heat the stator column 4 with heat conduction from the pump base 1D and prevent adhesion of the product in the stator column 4. Therefore, it is possible to reduce an adhesion amount of the product in the vacuum pump P4 as a whole.

The vacuum pump P4 in the fourth embodiment adopts a configuration in which the shield pipe 200 formed of the magnetic material is mounted on the wire through-hole 102 and a configuration in which the shield plate 201 formed of the magnetic material is disposed around the connector 100. Therefore, it is possible to reduce a magnetic flux leak of the coil 26 with the shield pipe 200 and the shield plate 201. It is possible to effectively prevent a trouble of a vacuum pump electric system due to the magnetic flux leak such as a malfunction of electric components inside the vacuum pump P4 due to leaked magnetic flux.

Further, the vacuum pump P4 in the fourth embodiment adopts, as a specific configuration of the heating portion 20, a configuration in which the heating plate 23 is separated into a plurality of heating plates as the two or more separated heating plates 23A and 23B in contact with one of the inner and outer thread-groove-exhaust-portion stators 18A and 18B. Therefore, for example, at a pump assembly stage in which the heating plate 23 is attached in contact with the ends of the inner and outer thread-groove-exhaust-portion stators 18A and 18B, the heating plate 23 can be individually attached to the respective inner and outer thread-groove-exhaust-portion stators 18A and 18B as the separated heating plates 23A and 23B separated into two or more. Therefore, even when a machining dimension error or an attachment dimension error in the length direction in the inner and outer thread-groove-exhaust-portion stators 18A and 18B is present, it is possible to easily attach the heating plate 23 to the inner and outer thread-groove-exhaust-portion stators 18A and 18B without being affected by the errors. Since it is unnecessary to highly accurately set a machining dimension and an attachment dimension in the length direction in the inner and outer thread-groove-exhaust-portion stators 18A and 18B, it is possible to attain a reduction in costs of the vacuum pump P4 as a whole.

The structure examples of the heating plates 23 shown in FIGS. 18 to 22 and the configuration example in which the material properties are different in the inner and outer separated heating plates 23A and 23B can be adopted independently from each other but may be adopted in combination according to necessity.

In the vacuum pump P4 in the fourth embodiment, the thread groove exhaust section Ps configures the thread groove pump parallel flow type. However, the present invention is not limited to the thread groove exhaust section Ps of this type. The present invention can be applied to all vacuum pumps including thread-groove-exhaust-portion stators. As the vacuum pumps to which the present invention can be applied, there are, for example, a type in which the thread groove exhaust section Ps including only an outer thread-groove-exhaust-portion stator is configured and a type in which the thread groove exhaust section Ps exhausts gas with an outer thread groove and thereafter successively exhausts gas with an inner thread groove.

he vacuum pumps P1, P2, P3, and P4 in the first to fourth embodiments explained above include the blade exhaust section Pt and the thread groove exhaust section Ps. However, the present invention can be applied to a vacuum pump including only the thread groove exhaust section Ps.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

EXPLANATION OF REFERENCE NUMERALS

1 Armor case
1A Pump case
1B Base spacer
1C Flange
1D Pump base
2 Gas inlet port
3 Gas outlet port
30 Exhaust pipe
4 Stator base
5 Rotating shaft
6 Rotor
60 Coupling section
61 First cylinder body
62 Second cylinder body
63 End member
7 Water cool pipe
8 Heat conduction pipe
10 Radial magnetic bearings
11 Axial magnetic bearing
12 Driving motor
13 Rotary blades
13E Rotary blade at the bottom stage
14 Fixed blades
18A Thread-groove-exhaust-portion stator on the inner side
18B Thread-groove-exhaust-portion stator on the outer side
19A, 19B Thread grooves
20 Heating portion
21 Recess
22 Heater spacer
23 Heating plate
23A, 23B Separated heating plates
24 Seal means
25 Yoke
26 Coil
27 Insulating plate
28 Protrusion
50 Sensor attachment hole
51 Temperature sensor
52 Seal means
70 Heating portion
71 Heater spacer
72 Recess
73 Yoke
74 Heating plate
75 Groove
76 Protrusion portion
77 Coil
78 Sensor attachment hole
79 Temperature sensor
80 Temperature sensor
81 Insulating plate
82 Resin
83 O-ring
84 O-ring groove
85 Minimum diameter portion
86 Protrusion portion
100 Connector
101 Connector mounting portion
102 Wire through-hole
103 Wire of a coil
200 Shield pipe
201 Shield plate
BT1, BT2, BT3, BT4, BT5 Fastening bolts
G1 Final gap (Gap between the rotary blade at the bottom stage and the upstream end of the connection opening)
G2 Air gap
G3 Separation gap
H Connection opening
M Intermediate member
N Lightening portion
P1, P2, P3, P4 Vacuum pumps
Pt Blade exhaust section
Ps Thread groove exhaust section
R1 Inner thread groove exhaust passage
R2 Outer thread groove exhaust passage
S1 Annular confluence channel
S2 Lateral hole channel
S3 Annular confluence channel

What is claimed is:

1. A vacuum pump comprising:
a rotor enclosed in a pump case;
a rotating shaft fixed to the rotor;
a supporting means that rotatably supports the rotating shaft;
a driving means that rotates the rotating shaft; and
a thread-groove-exhaust-portion stator that forms a thread grove exhaust passage between the thread-groove-exhaust-portion stator and an outer circumferential side of or an inner circumferential side of the rotor, wherein
a heating portion is provided below the thread-groove-exhaust-portion stator,
the heating portion includes a yoke, a coil, and a heating plate in contact with the thread groove exhaust portion stator, the yoke is disposed in a heater spacer,
the heater spacer is formed by a member formed by a different material from the yoke, and
the yoke and the heating plate in contact with the thread groove exhaust portion stator, are heated with electromagnetic induction heating by eddy current generated in the yoke and the heating plate by feeding an alternating current to the coil.

2. The vacuum pump according to claim 1, wherein
the rotor is enclosed in a base spacer,
the stator base is disposed below the rotor,
the heating portion is provided between the thread-groove-exhaust-portion stator and the stator base,
the heating plate is in contact with the thread-groove-exhaust-portion stator and attached to the heater spacer, and
at least one of the heater spacer, the thread-groove-exhaust-portion stator, the base spacer, and the stator base is heated by heating the yoke and the heating plate.

3. The vacuum pump according to claim 2, wherein the heating portion includes:

a temperature sensor attached to the heating plate, or the thread-groove-exhaust-portion stator, or the yoke; and a temperature control means that controls, on the basis of a detection value in the temperature sensor, the heating plate, or the thread-groove-exhaust-portion stator, or the yoke to have a predetermined temperature.

4. The vacuum pump according to claim 3, wherein the heating portion includes:

a temperature sensor attached to the coil; and a protection control means that controls, on the basis of a detection value in the temperature sensor, the coil not to have temperature exceeding a predetermined temperature.

5. The vacuum pump according to claim 2, wherein the heating portion includes:

a temperature sensor attached to the coil; and a protection control means that controls, on the basis of a detection value in the temperature sensor, the coil not to have temperature exceeding a predetermined temperature.

6. The vacuum pump according to claim 1, wherein the heating portion includes:

a temperature sensor attached to the heating plate, or the thread-groove-exhaust-portion stator, or the yoke; and a temperature control means that controls, on the basis of a detection value in the temperature sensor, the heating plate, or the thread-groove-exhaust-portion stator, or the yoke to have a predetermined temperature.

7. The vacuum pump according to claim 6, wherein the heating portion includes:

a temperature sensor attached to the coil; and a protection control means that controls, on the basis of a detection value in the temperature sensor, the coil not to have temperature exceeding a predetermined temperature.

8. The vacuum pump according to claim 1, wherein the heating portion includes:

a temperature sensor attached to the coil; and a protection control means that controls, on the basis of a detection value in the temperature sensor, the coil not to have temperature exceeding a predetermined temperature.

9. A vacuum pump comprising:

a rotor enclosed in a pump case;

a rotating shaft fixed to the rotor;

a supporting means that rotatably supports the rotating shaft;

a driving means that rotates the rotating shaft; and a thread-groove-exhaust-portion stator that forms a thread grove exhaust passage between the thread-groove-exhaust-portion stator and an outer circumferential side of or an inner circumferential side of the rotor, wherein a heating portion is provided below the thread-groove-exhaust-portion stator, the heating portion includes a yoke, a coil, and a heating plate, further includes a wire that connects the coil to a connector and a magnetic-flux-leak reducing means, the yoke is disposed in a heater spacer, the yoke and the heating plate are heated with electromagnetic induction heating by eddy current generated in the yoke and the heating plate by feeding an alternating current to the coil, and the heater spacer is formed by a member formed by a different material from the yoke.

10. The vacuum pump according to claim 9, wherein the rotor is enclosed in a base spacer, a stator base is disposed below the rotor, the heating portion is provided between the thread-groove-exhaust-portion stator and the base spacer, the heating plate is in contact with the thread-groove-exhaust-portion stator and attached to the heater spacer, the heating portion further includes a wire through-hole formed in only the heater spacer or both of the heater spacer and the yoke, the wire is inserted through the wire through-hole, the magnetic-flux-leak reducing means is mounted around the wire through-hole or the connector, the alternating-current is fed from the connector via the wire, and at least one of the heater spacer, the thread-groove-exhaust-portion stator, the base spacer, and the stator base is heated by heating the yoke and the heating plate.

* * * * *